US009534381B2

(12) United States Patent
Hiscock et al.

(10) Patent No.: US 9,534,381 B2
(45) Date of Patent: Jan. 3, 2017

(54) HINGED CORNER FORM FOR AN INSULATING CONCRETE FORM SYSTEM

(71) Applicant: Airlite Plastics Co., Omaha, NE (US)

(72) Inventors: Barry Hiscock, Port Hope (CA); Sheldon Warman, Oakville (CA)

(73) Assignee: Airlite Plastics Co., Omaha, NE (US)

( * ) Notice: Subject to any disclaimer, the term of this patent is extended or adjusted under 35 U.S.C. 154(b) by 0 days.

(21) Appl. No.: 14/810,125

(22) Filed: Jul. 27, 2015

(65) Prior Publication Data

US 2015/0330092 A1 Nov. 19, 2015

Related U.S. Application Data

(63) Continuation of application No. 13/267,514, filed on Oct. 6, 2011, now Pat. No. 9,091,062.

(60) Provisional application No. 61/390,882, filed on Oct. 7, 2010.

(51) Int. Cl.

| | |
|---|---|
| ***E04B 2/86*** | (2006.01) |
| ***E04B 1/16*** | (2006.01) |
| *E04B 2/02* | (2006.01) |
| *E04F 13/073* | (2006.01) |
| *E04F 13/072* | (2006.01) |

(52) U.S. Cl.

CPC ..... *E04B 2/8635* (2013.01); *E04B 1/168* (2013.01); *E04B 2002/0263* (2013.01); *E04B 2002/0282* (2013.01); *E04B 2002/0284* (2013.01); *E04B 2002/867* (2013.01); *E04F 13/072* (2013.01); *E04F 13/0733* (2013.01)

(58) Field of Classification Search

CPC ..... E04B 1/16; E04B 1/168; E04B 2/86; E04B 2/8635; E04B 2002/0263; E04B 2002/028; E04B 2002/0282; E04B 2002/0284; E04B 2002/867

USPC ..... 52/275, 276, 277, 278, 279, 426

See application file for complete search history.

(56) References Cited

U.S. PATENT DOCUMENTS

| | | | |
|---|---|---|---|
| 5,039,058 | A | 8/1991 | Boeshart |
| 6,170,220 | B1 | 1/2001 | Moore, Jr. |
| 6,314,697 | B1 | 11/2001 | Moore, Jr. |
| 6,318,040 | B1 | 11/2001 | Moore, Jr. |
| 6,363,683 | B1 | 4/2002 | Moore, Jr. |
| 6,438,918 | B2 | 8/2002 | Moore, Jr. et al. |
| 6,647,686 | B2 | 11/2003 | Dunn et al. |
| 6,935,081 | B2 | 8/2005 | Dunn et al. |
| 8,037,652 | B2 | 10/2011 | Marshall et al. |
| 2002/0116889 | A1 | 8/2002 | Moore |
| 2006/0260240 | A1 | 11/2006 | Patz et al. |
| 2008/0302045 | A1 | 12/2008 | Roach |
| 2009/0013629 | A1 | 1/2009 | Boeshart |
| 2010/0050551 | A1 | 3/2010 | Boeshart |

*Primary Examiner* — Michael Safavi

(74) *Attorney, Agent, or Firm* — Banner & Witcoff, Ltd.

(57) ABSTRACT

A corner form panel used in an insulating concrete form system includes a hinged corner web member at least partially embedded in each of two segments of the form panel. The hinged corner web member enables the two segments to rotate with respect to each other, so that the form panel can be opened to a flat configuration for shipping, and folded into a corner configuration at the jobsite. Both inside and outside corner panels may be provided, and may use different hinged corner web members. The corner web member may include features for connecting the inside and outside corner panels, to reinforce the resulting form unit.

9 Claims, 24 Drawing Sheets

HINGED CORNER FORM FOR AN INSULATING CONCRETE FORM SYSTEM

This application is a continuation application of U.S. Ser. No. 13/267,514, filed Oct. 6, 2011, entitled Hinged Corner Form for an Insulating Concrete Form System (will issue on Jul. 28, 2015 as U.S. Pat. No. 9,091,062) claims priority to and the benefit of U.S. Provisional Application Ser. No. 61/390,882, filed Oct. 7, 2010, entitled Hinged Corner Form for an Insulating Concrete Form System, each of which is incorporated herein by reference and made part hereof.

BACKGROUND OF THE INVENTION

Insulating concrete forms are known, and provide advantages in the construction of homes and other buildings. In a typical insulating concrete form system, forming units include panels of an insulating material, such as expanded polystyrene, held in spaced-apart relation by tying members. The forming units are stacked, and form a cavity between the panels into which concrete is poured. Once the concrete has hardened, the insulating panels are left in place, and contribute to the insulating value of the resulting wall.

In some systems, the ends of the tying members are embedded in the foam panels, so that the forming units are pre-assembled. This arrangement has the disadvantage that the forming units require substantial space during shipping, as each unit includes the empty airspace between the panels.

In other systems, called "knock down" or "assemble-on-site" systems, each panel includes embedded web members that pivot to flatten the forms or that include attachment points for separate ties. In the latter forms, the panels and ties can be shipped separately, and the ties are connected at the building site to the attachment points, thereby spacing the panels with the cavity between them. The form system is built up in this way, and then concrete is poured into the wall cavity. This kind of system results in lower shipping cost, because the separate panels can be stacked more compactly for shipping.

BRIEF SUMMARY OF THE INVENTION

The invention provides improvements to corner forms particularly useful in "knock down" or "assemble on site" systems. The corner forms may include a hinged corner web member that enables corner form panels to be opened to a flat configuration for shipping, and folded into a corner configuration at the jobsite. Both inside and outside corner panels may be provided, and may use different hinged corner web members. The corner web member may include features for connecting the inside and outside corner panels, to reinforce the resulting form unit.

According to one aspect of the invention, a hinged knock down corner form panel includes a first insulating segment having inner and outer sides, a top, a bottom, a first end, and a second end, and comprises a second insulating segment having inner and outer sides, a top, a bottom, a first end, and a second end. The corner form panel further includes a web member partially embedded in the first segment and partially embedded in the second segment. The web member joins the first and second segments and includes a flexible portion enabling the first and second segments to be angularly displaced relative to each other from a configuration in which the first and second segments are parallel and disposed end-to-end, to a configuration in which the first and second segments form an angle. In some embodiments, the web member is molded of a polymer, and the flexible portion is a living hinge. In some embodiments, the web member further includes two connection features protruding respectively from the first segment and the second segment. The connection features may protrude from the inner sides of the first and second segments and the hinged knock down corner form panel may be configured to make an outside corner of a form. The connection features may protrude from the inner sides of the first and second segments and the hinged knock down corner form panel may be configured to make an inside corner of a form. The protruding portions of the web member may meet when the hinged knock down corner form panel is in the configuration in which the first and second segments form an angle. In some embodiments, one corner of the first end of the first insulating segment is beveled, the bevel having a first bevel face extending from the top to the bottom of the first segment; and one corner of the first end of the second insulating segment is beveled, the bevel having a second bevel face extending from the top to the bottom of the second segment; and the first and second bevel faces substantially touch when the hinged knock down corner form panel is in the configuration in which the first and second segments form an angle.

According to another aspect of the invention, a web member for a knock down corner panel of an insulating concrete form includes a first inner portion and a second inner portion. The first and second inner portions are joined along a central longitudinal axis by a line of reduced thickness, enabling the first and second portions to be angularly displaced in relation to each other about the central longitudinal axis. The web member may be molded as a single unit from a polymer, wherein the line of reduced thickness forms a living hinge. In some embodiments, the first inner portion includes first and second generally longitudinal furring strips separated by one or more openings, and the second inner portion includes third and fourth generally longitudinal furring strips separated by one or more openings. In some embodiments, the web member further comprises a first wing substantially rigidly joined to the first inner portion along an edge of the first inner portion opposite the central longitudinal axis, the first wing defining a plurality of openings and including a lip disposed at an angle to the first wing on a longitudinal edge of the first wing opposite the first inner portion; and also further comprises a second wing substantially rigidly joined to the second inner portion along an edge of the second inner portion opposite the central longitudinal axis, the second wing defining a plurality of openings and including a lip disposed at an angle to the second wing on a longitudinal edge of the second wing opposite the second inner portion. The web member may include portions joined to the wings at outer edges of the wings and configured to protrude from a foam panel when the web member is embedded in the foam panel. The protruding portions may be configured to meet when the web member is folded into its installed configuration.

According to another aspect, a method of making a corner form unit in an insulating concrete form system comprises providing an outside corner form panel having two insulating segments and a hinged outside web member joining the two insulating segments, the hinged outside web member enabling the two insulating segments of the outside corner form panel to be angularly displaced with respect to each other about a central longitudinal axis of the hinged outside web member. The method further comprises providing an inside corner form panel having two insulating segments and a hinged inside web member joining the two insulating segments, the inside hinged web member enabling the two insulating segments of the inside corner form panel to be angularly displaced with respect to each other about a central longitudinal axis of the inside web member. The outside corner form panel is folded into a configuration in which its two insulating segments form an outside corner of a corner form unit, and the inside corner form panel is folded into a configuration in which its two insulating segments form an inside corner of a corner form unit. The method further comprises connecting the outside corner form panel and the inside corner form panel, in some embodiments, portions of the hinged outside web member protrude from respective segments of the outside corner form panel and portions of the inside web member protrude from respective segments of the inside corner form panel, and the method further comprises connecting at least one protruding portion of the outside corner web member with at least one protruding portion of the inside corner web member.

According to another aspect, an insulating concrete form comprises an outside corner form panel having two insulating segments and a hinged outside web member joining the two insulating segments, the hinged outside web member enabling the two insulating segments of the outside corner form panel to be angularly displaced with respect to each other about a central longitudinal axis of the hinged outside web member. The insulating concrete form further includes an inside corner form panel having two insulating segments and a hinged inside web member joining the two insulating segments, the hinged inside web member enabling the two insulating segments of the inside corner form panel to be angularly displaced with respect to each other about a central longitudinal axis of the inside web member. The two insulating segments of the outside corner form panel are disposed at an angle with respect to each other, and the two insulating segments of the inside corner form panel are disposed at an angle to each other, and the insulating concrete form further comprises at least one tying member joining the outside corner form panel and the inside corner form panel to hold the panels in spaced relation. The at least one tying member may comprise a flexible tying member. The at least one tying member may engage one or both of the inside hinged web member and the outside hinged web member. The at least one tying member may comprise a structure that engages at least one element protruding from the outside corner form panel and engages at least one element protruding from the inside corner form panel. In some embodiments, the structure is a structural assembly made up of multiple parts. In some embodiments, the structure comprises two connector features configured to engage elements protruding respectively from the two insulating segments of the inside corner form panel or configured to engage elements protruding respectively from the two insulating segments of the outside corner form panel, and wherein the two connector features are disposed at an angle to each other. In some embodiments, the structure comprises a first connector having connector features disposed at an angle to each other and configured to engage elements protruding respectively from the two insulating segments of the inside corner form panel; and comprises a second connector having connector features disposed at an angle to each other and configured to engage elements protruding respectively from the two insulating segments of the outside corner form panel; and comprises a link engaging the first and second connectors to hold the first and second connectors in spaced relation. The link may engage the first and second connectors using a snap feature. The link may comprise one or more seats for holding rebar. In some embodiments, the structure comprises a first connector having connector features disposed at an angle to each other and configured to engage elements protruding respectively from the two insulating segments of the inside corner form panel; and comprises a second connector having a connector feature configured to engage an element protruding from the outside corner form panel; and comprises a link engaging the first and second connectors to hold the first and second connectors in spaced relation.

BRIEF SUMMARY OF THE INVENTION

FIG. 9A illustrates an embodiment of a corner reinforcement, in accordance with the principles of the invention.

FIG. 10A illustrates an embodiment of a structural assembly for reinforcing a corner joint, in accordance with the principles of the invention.

DETAILED DESCRIPTION OF THE INVENTION

Figure 1:
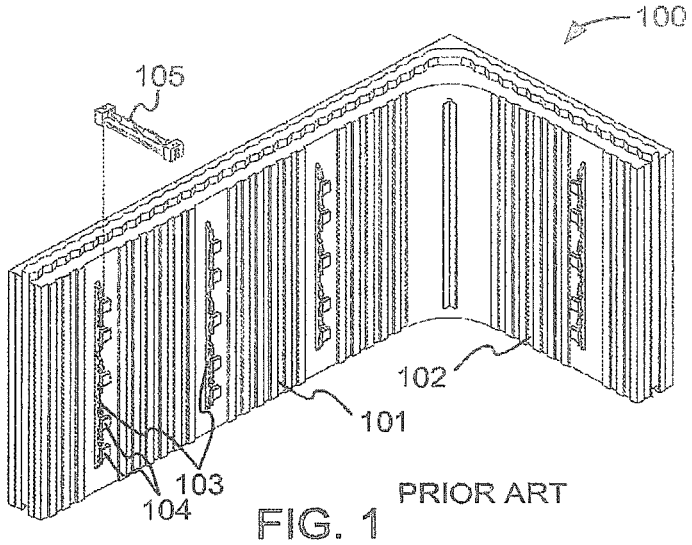
FIG. 1 illustrates a conventional outside corner form panel.

It is understood that the invention is not limited to the particular methodology, components, and systems, etc., described herein, as these may vary as the skilled artisan will recognize. It is also to be understood that the terminology used herein is used for the purpose of describing particular embodiments only, and Ls not intended to limit the scope of the invention. It also is be noted that as used herein and in the appended claims, the singular forms "a," "an," and "the" include the plural reference unless the context clearly dictates otherwise. Thus, for example, a reference to "a panel" is a reference to one or more panels and equivalents thereof known to those skilled in the art.

Unless defined otherwise, all technical and scientific terms used herein have the same meanings as commonly understood by one of ordinary skill in the art to which the invention pertains. The embodiments of the invention and the various features and advantageous details thereof are explained more fully with reference to the non-limiting embodiments and examples that are described and/or illustrated in the accompanying drawings and detailed in the following description. It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments of the invention. The examples used herein are intended merely to facilitate an understanding of ways in which the invention may be practiced and to further enable those of skill in the art to practice the embodiments of the invention. Accordingly, the examples and embodiments herein should not be construed as limiting the scope of the invention, which is defined solely by the appended claims and applicable law. Moreover, it is noted that like reference numerals may reference similar parts throughout the several views of the drawings.

Figure 2:
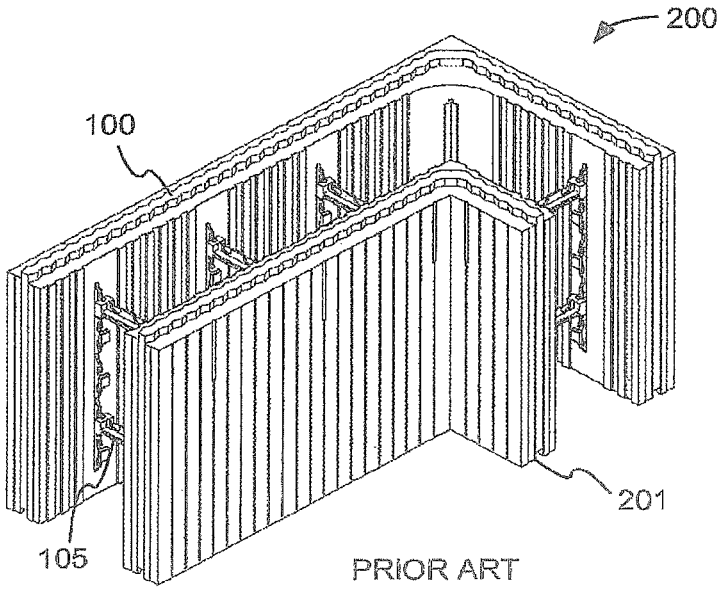
FIG. 2 illustrates a conventional corner form unit including the outside corner form panel of FIG. 1 and an inside corner form panel.

Even in previous knock down or assemble-on-site systems, corner forms have resulted in shipping inefficiencies. FIG. 1 illustrates a prior art outside corner form panel 100. Corner form panel 100 includes a first leg 101 and a second leg 102, at right angles to each other. Corner form panel 100 also has web members 103 partially embedded, with attachment features 104 protruding from the inner sides of first leg 101 and second leg 102. A tie 105 is configured to attach to any of the attachment features 104, and also to similar features in an inside corner form panel. Several ties would typically be used to assemble the corner form unit 200 shown in FIG. 2, including outside corner form panel 100 and inside corner form panel 201.

Prior outside corner form panel 100 is molded as a unit, such that first leg 101 and second leg 102 are rigidly and orthogonally connected. Inside corner form panel 201 is made in a similar way. These prior art corner form panels may not stack efficiently for shipping.

In accordance with embodiments of the invention, inside and outside corner form panels are hinged, so that they can be laid flat, facilitating compact stacking for shipping. The corner panels are "folded" during assembly at the job site to form corners.

Figure 3A:
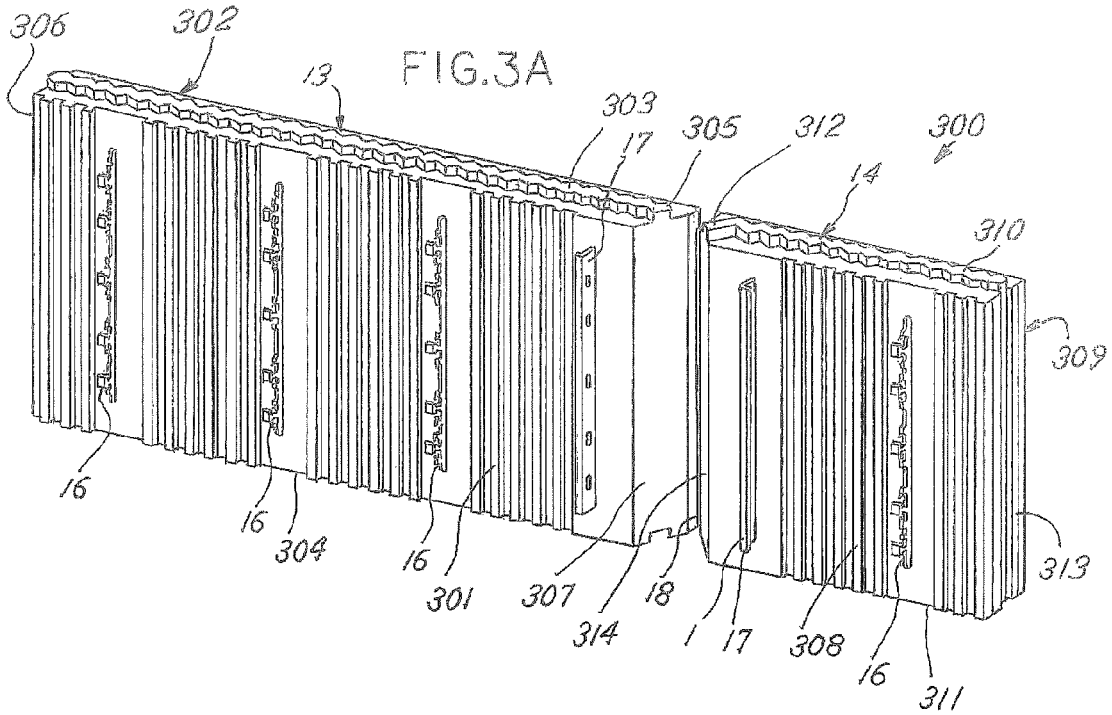
FIG. 3A illustrates an embodiment of an outside corner form panel, constructed according to principles of the invention.

FIG. 3A illustrates an embodiment of an outside corner form panel 300, in accordance with the principles of the invention. Outside corner form panel 300 includes a first segment 13 and a second segment 14. First segment 13 includes an inner side 301, an outer side 302 (not visible), a top 303, a bottom 304, a first end 305, and a second end 306. One corner of first end 305 is beveled, creating a bevel face 307 that extends from top 303 to bottom 304 of segment 13. Similarly, second segment 14 includes an inner side 308, an outer side 309 (not visible), a top 310, a bottom 311, a first end 312, and a second end 313. One corner of first end 312 is beveled, creating a bevel face 314 that extends from top 310 to bottom 311 of segment 14. Segments 13 and 14 a joined by an outside corner web member 1 partially embedded in first segment 13 and partially embedded in second segment 14. Only small portions of outside corner web member 1 are visible in FIG. 3A, namely connection features 17 protruding from inner sides 301 and 308 of segments 13 and 14. In addition to outside corner web member 1, segments 13 and 14 also have partially embedded within them other web members 16, which may be similar to web members 103 shown in FIG. 1.

Figure 3B:
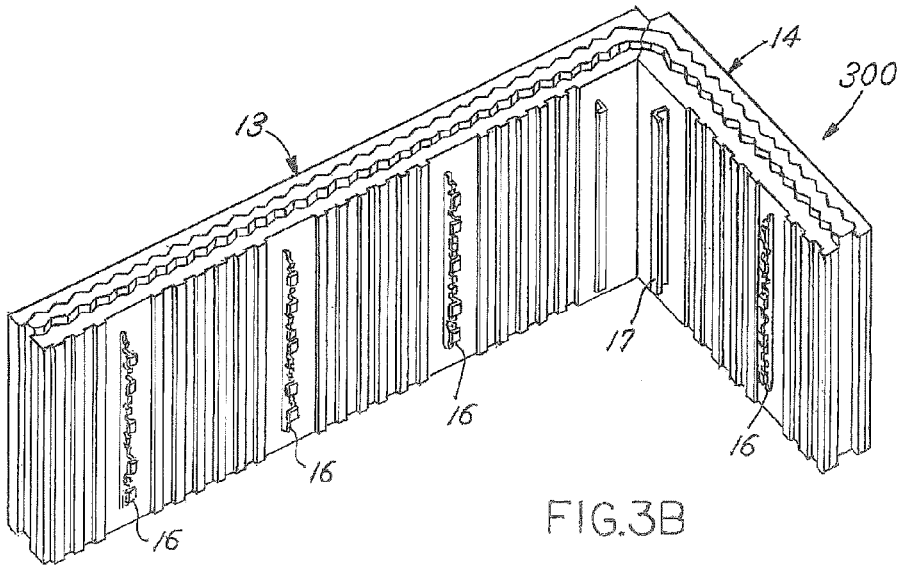
FIG. 3B illustrates the outside corner form panel of FIG. 3A in an angled configuration.

Outside corner web member 1 includes a flexible portion. 18 that enables segments 13 and 14 to rotate relative to each other, from the configuration of FIG. 3A in which segments 13 and 14 are parallel and disposed end-to-end, to the configuration of FIG. 3B, in which segments 13 and 14 form an angle, with bevel faces 306 and 313 substantially touching. It will be apparent that outside corner form panel 300 is configured to form an outside corner of a form unit.

Figure 4A:
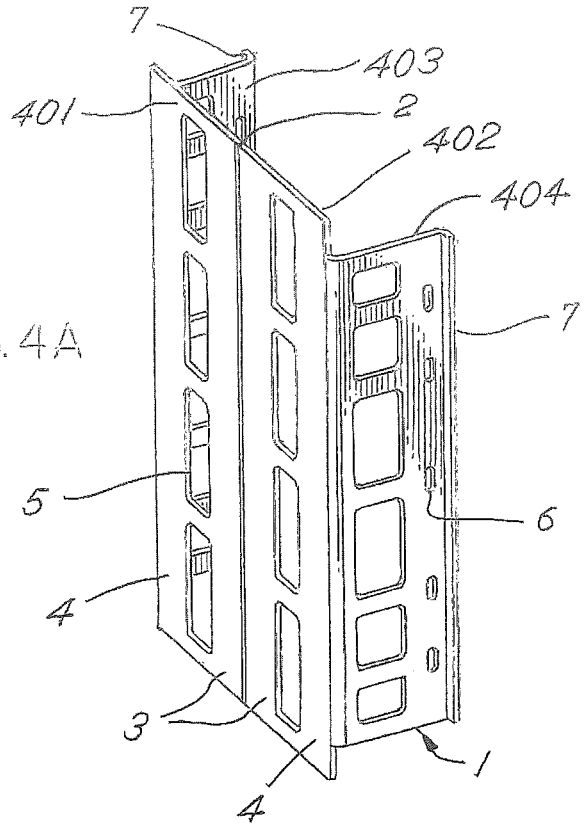
FIG. 4A shows an embodiment of an outside corner web member, in accordance with the principles of the invention.

The operation of outside corner form panel 300 is enabled in part by outside corner web member 1. FIG. 4A shows an embodiment of outside corner web member 1 in isolation, in the configuration in which it may be molded. Outside corner web member 1 is preferably molded as a single unit, for example from polypropylene or another suitable polymer. Outside corner web member 1 includes first and second generally flat inner portions 401, 402, joined along a central longitudinal axis by a line of reduced thickness, forming a living hinge 2. In this application, a living hinge is a thin, flexible portion of a molded plastic or similar part that allows other portions of the part to rotate with respect to each other about the hinge. Living hinge 2 enables inner portions 401 and 402 to rotate relative to one another about the central longitudinal axis.

Each of inner portions 401 and 402 includes an inner furring strip 3 adjacent living hinge 2, and also includes an outer furring strip 4. Furring strips 3 and 4 provide structure for attaching finishing materials to the eventual formed wall. Furring strips 3 and 4 are separated by openings 5, which enable the foam material of segments 13 and 14 to flow through outside corner web member 1 during molding of segments 13 and 14, ensuring that outside corner web member 1 is securely engaged with segments 13 and 14, to withstand handling and assembly of the forms, and the loads imparted by wet concrete during pouring of the wall.

Outside corner web member 1 also includes wings 403 and 404, which are substantially rigidly joined to outer edges (opposite the central longitudinal axis) of first and second inner portions 401 and 402. Wings 403 and 404 also include openings for engagement with the insulating foam material during molding of segments 13 and 14. Wings 403 and 404 define reinforcement connection openings 6, configured for the attachment of additional tying elements, as will be described in more detail below. Finally, lips 7 are disposed at an angle to wings 403 and 404, lending rigidity to outside corner web member 1. Lips 7 may also be used in molding and assembling the form, as will be described in more detail below.

During molding of outside corner form panel 300, inner portion 401 and wing 403 are substantially embedded in one of segments 13 and 14, and inner portion 402 and wing 404 are embedded in the other of segments 13 and 14. For example, outside corner web member 1 may be placed within a mold having cavities configured to mold segments 13 and 14, and the insulating material of which segments 13 and 14 are made is allowed to fill the mold cavities, engulfing the embedded portions of outside corner web member 1. Additional web members such as web members 16 may also be placed in the mold to also be at least partially embedded in the insulating material during molding. The insulating material may be expanded polystyrene or another suitable material. Lips 7 may engage with complementary features in the mold to hold outside corner web member 1 in place in the mold during molding of panels 13 and 14. Once the insulating material is hardened, outside corner form panel 300 is removed from the mold, including substantially embedded outside corner web member 1. Portions of wings 403 and 404, including reinforcement connection openings 6 and lips 7, may protrude from segments 13 and 14 after molding.

Figure 4B:
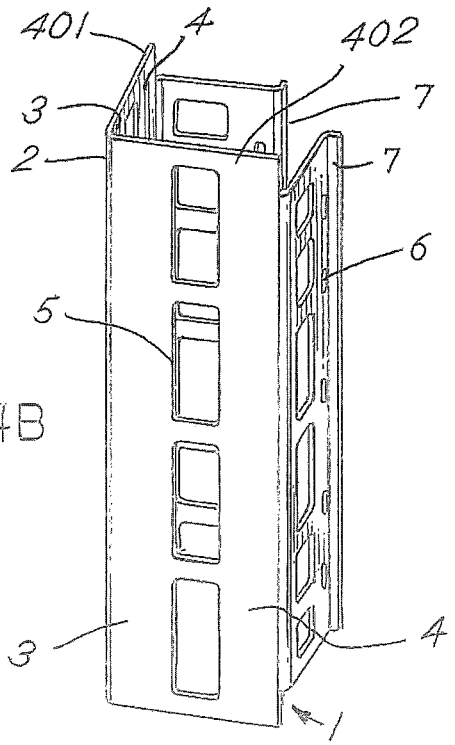
FIG. 4B shows the outside corner web member of FIG. 4A, in a folded configuration.

FIG. 4B shows outside corner web member 1 in a folded state, as it would be configured when outside corner form panel 300 is folded into the right angle configuration of FIG. 3B. Inner portions 401 and 402 have rotated around the central longitudinal axis (via living hinge 2) to form an angle between them. As is best seen in FIG. 3B, lips 7 and reinforcement connection openings 6 are exposed outside panels 13 and 14. Lips 7 engage with the concrete eventually poured into a form that includes outside corner form panel 300, helping to ensure a firm connection of outside corner form panel 300 to the wall. Connection features 17 may include lips 7 and portions of wings 403 and 404.

Figure 5A:
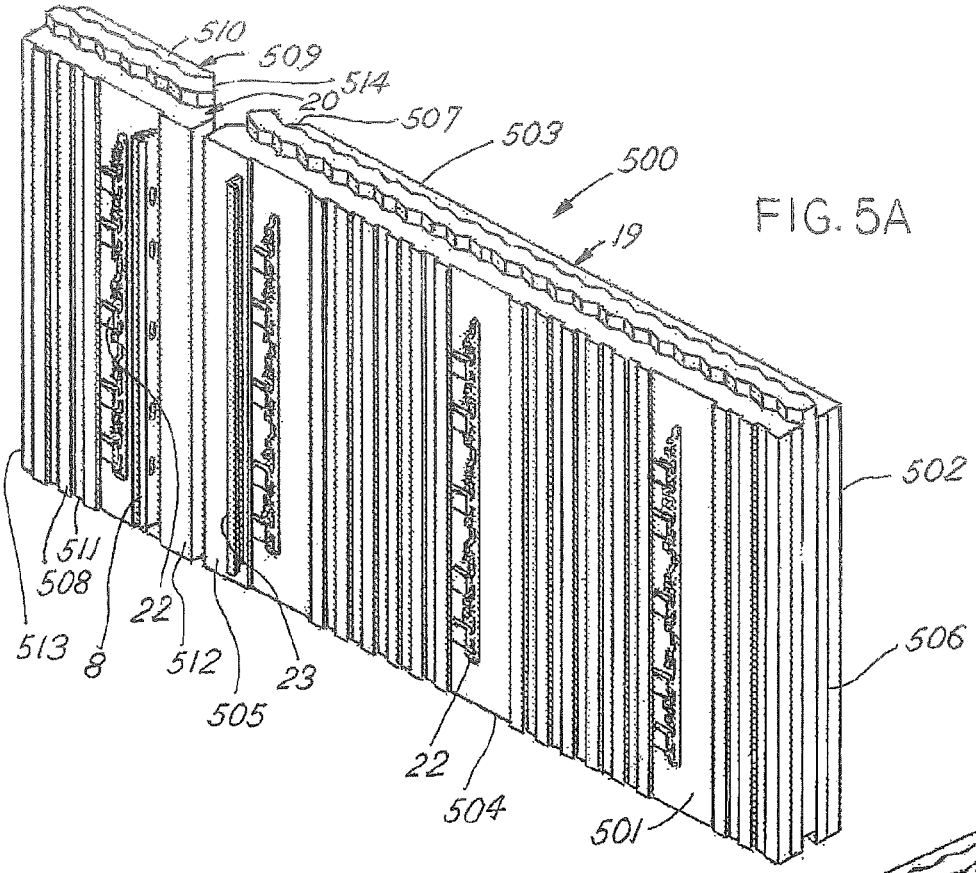
FIG. 5A illustrates an embodiment of an inside corner form panel, in accordance with the principles of the invention, in a flat configuration for shipping.
Figure 5B:
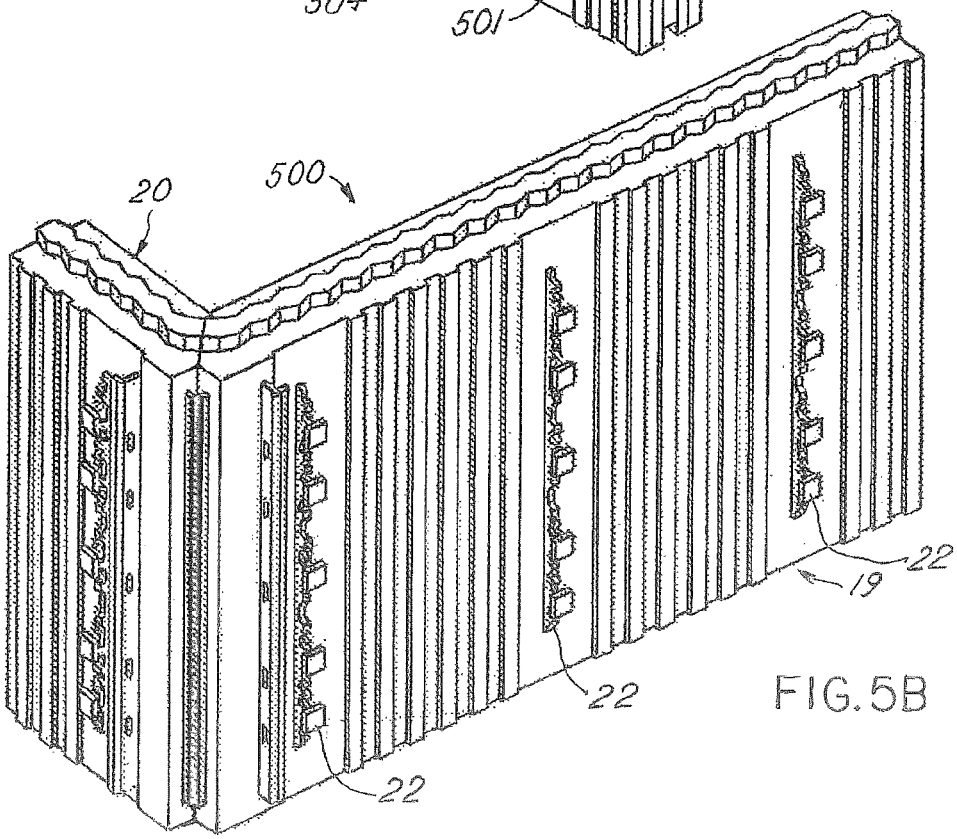
FIG. 5B shows the inside corner form panel of FIG. 5A, in a folded configuration for use.

FIGS. 5A and 5B illustrate an embodiment of an inside corner form panel 500, made in a manner similar to outside corner form panel 300. Inside corner form panel 500 includes segments 19 and 20, made of molded insulating material such as expanded polystyrene. Segment 19 includes inner and outer sides 501 and 502, a top 503, a bottom 504, a first end 505 and a second end 506. First end 505 includes a bevel face 507 extending from top 503 to bottom 504 of segment 19. Similarly, second segment 20 includes an inner and outer sides 508 and 509, a top 510, a bottom 511, a first end 512, and a second end 513. One corner of first end 512 is beveled, creating a bevel face 514 that extends from top 510 to bottom 511 of segment 20. Segments 19 and 20 a joined by an inside corner web member 8 partially embedded in first segment 19 and partially embedded in second segment 20. Only small portions of inside corner web member 8 are visible in FIG. 5A, namely connection features 23 protruding from inner sides 501 and 508 of segments 19 and 20. In addition to inside corner web member 8, segments 19 and 20 also have partially embedded within them other web members 22, which may be similar to web members 103 shown in FIG. 1.

Inside corner form panel 500 differs from outside corner form panel 300 in that bevel faces 507 and 514 face the side of the panel that will form the outside of the wall, rather than facing the cavity where concrete will be poured. FIG. 5B shows inside corner form panel. 500 in its folded configuration for use, with bevel faces 507 and 514 substantially touching, and with segments 19 and 20 forming an angle between them.

Figure 6A:
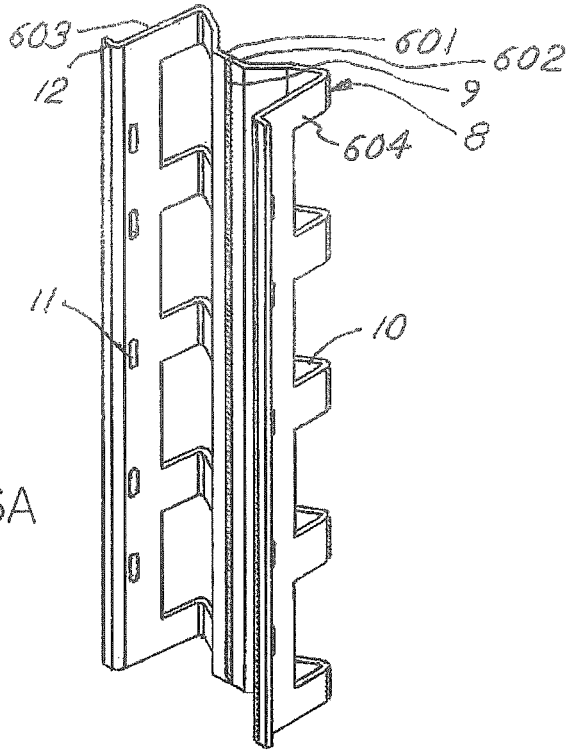
FIG. 6A shows an embodiment of an inside corner web member, in accordance with the principles of the invention.

In addition, inside corner web member 8 may be of a different configuration than outside corner web member 1. FIG. 6A shows an embodiment of inside corner web member 8 in isolation, in the configuration in which it may be molded, which is also the configuration inside corner web member 8 is in when inside corner form panel 500 is opened flat, as shown in FIG. 5A.

Inside corner web member 8 includes small generally flat inner portions 601 and 602 joined along a central longitudinal axis by a line of reduced thickness, forming a living hinge 9. Angled wings 603 and 604 are joined to inner portions 601 and 602. Openings 10 provide for flow of insulating material through insider corner web member 8 during molding of segments 19 and 20. Lips 12 may be used to hold inside corner web member 8 in the panel mold, and may also engage the concrete in the eventual wall. Wings 603 and 604 also define reinforcement connection openings 11. Connection features 23 may include lips 12 and portions of wings 603 and 604.

Figure 6B:
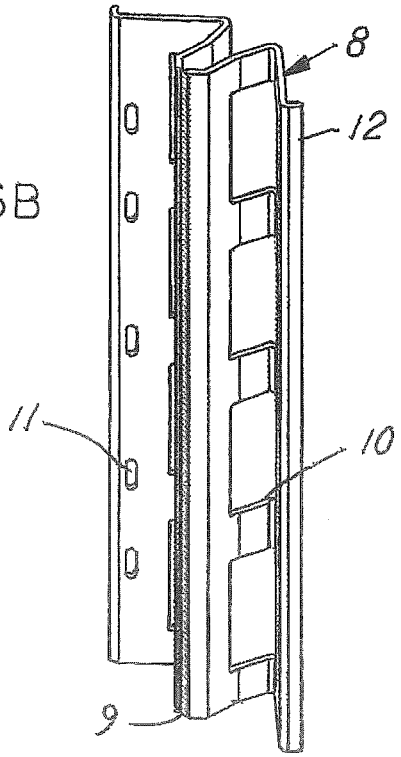
FIG. 6B shows the inside corner web member of FIG. 6A, in a folded configuration.

FIG. 6B illustrates inside corner web member 8 in its folded configuration, as it is when inside corner form panel 500 is in the folded configuration shown in FIG. 5B.

Figure 7:
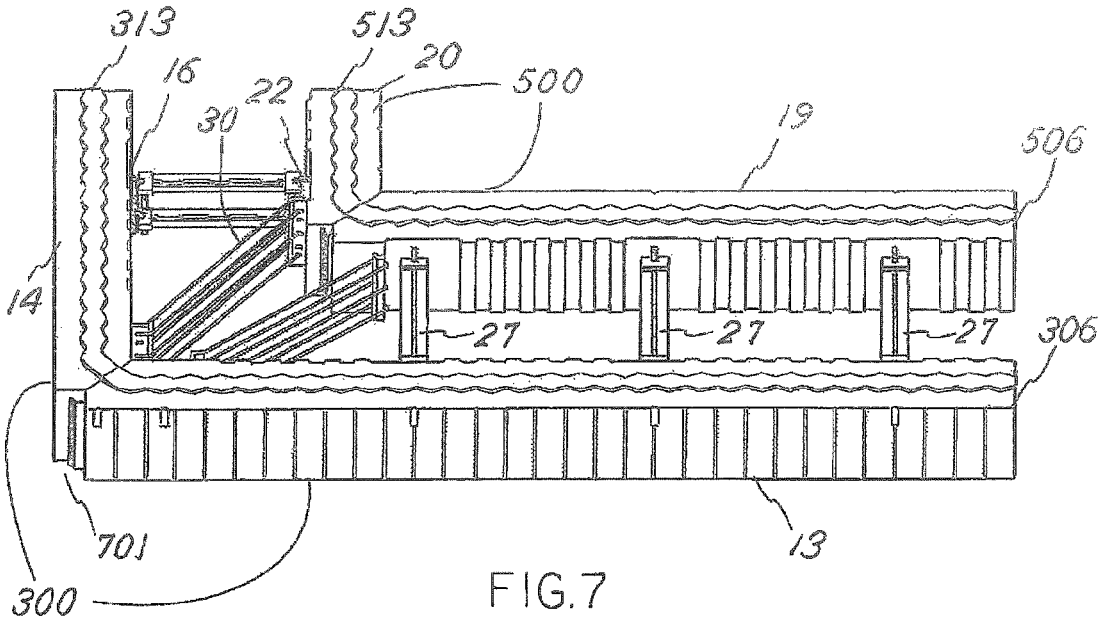
FIG. 7 shows an embodiment of an assembled corner form unit in accordance with the principles of the invention, including the outside corner form panel of FIG. 3A and the inside corner form panel of FIG. 5A.

Outside corner form panel 300 and inside corner form panel 500 may be assembled into a corner form unit, as shown in FIG. 7. The joints formed by living hinges 2 and 9, along with bevel faces 307, 314, 507, and 514, seal the corner against leaking of concrete during pouring. Reinforcing members 30 may extend between reinforcement connection openings 6 of outside corner form panel 300 and reinforcement connection openings 11 of inside corner form panel 500. For example, reinforcing member 30 may be zip ties, wire, or another suitable means of connecting outside corner web member 1 with inside corner web member 8. In addition, web members 16 of outside corner form panel 300 are configured to align with web members 22 of inside corner form panel, so that ties 27 can be conveniently placed across the space where concrete will be poured. Preferably, reinforcing members 30 are installed snugly, to produce a light tension against outside and inside corner form panels 300 and 500. In conjunction with the embedded corner web members 1 and 8, and other web members 16 and 22, a strong and stable corner results that will easily withstand the pressures imparted by poured concrete.

If desired, gap 701 may be filled, for example with a low expansion foam and smoothed to the exterior of the wall using a utility knife or similar tool.

Segments 13 and 19 are also preferably sized so that their ends 306 and 506 coincide for connection to additional form panels that form up other parts of the wall. Similarly, segments 14 and 20 are preferably sized so that their ends 313 and 513 coincide. For example, the corner arrangement of FIG. 7 could be compatible with other components of the ARXX Edge forming system, available from the assignee, ARXX Corporation of Cobourg, Ontario, Canada. Embodiments of the invention could be used with other forming systems as well.

Figure 8:
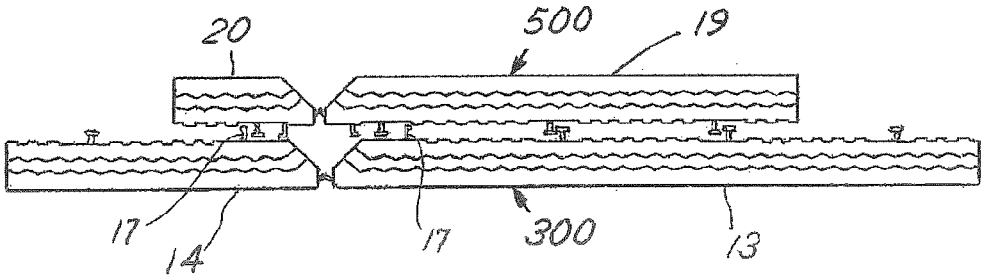
FIG. 8 illustrates the outside and inside corner form panels of FIGS. 3A and 5A, stacked compactly, in accordance with the principles of the invention.

FIG. 8 illustrates how both outside and inside corner form panels 300 and 500 can stack compactly for shipping, storage, or other purposes. In accordance with principles of the invention, the components required to form up corners of an insulating concrete form system can be shipped nearly as efficiently as flat panels used for forming up wall sections. More efficient use of space in shipping may result in lower shipping costs as compared with shipping rigid corner forms, and may also result in lesser environmental impact, since fewer truck loads may be required for shipping, resulting in less vehicle emissions.

While the embodiments described above relate to a form that makes a right-angle (90 degree) corner, it will be recognized that corner form panels in accordance with principles of the invention may also be made to form corners of other angles.

Many other variations are possible, in accordance with other embodiments.

For example, FIG. 9A illustrates an embodiment of a corner reinforcement that may be used in place of the zip tie or wire reinforcements 30 described above. In the embodiment of FIG. 9A, a structural assembly 900 is made up of three parts to connect between the attachment features of webs 16 and 22, of outside and inside corner form panels 300 and 500. A first connector 901 is configured to attach to two of attachment features 16 of outside corner form panel 300. A second connector 902 is configured to attach to two of attachment features 22 of inside corner form panel 500. A link 903 engages first and second connectors 901 and 902 to join them. For example, snap features 904 may engage with holes 905 and 906, in first and second connectors 901 and 902. Snap features 904 also allow disassembly of assembly 900, if desired.

Connector features 907 on both first and second connectors 901 and 902 are complementary to the attachment features 104 on webs 16 and 22. For example, these features may be compatible with webs used in the ARXX Edge forming system available from ARXX Corporation of Cobourg, Ontario, Canada, although other kinds of features may also be used. In some embodiments, connectors 901 and 902 snap onto the attachment features of the webs, and are also removable if desired.

Link 903 may include a raised portion 908 with one or more seats 909 for holding rebar. Slots 910 may be provided on connector member 902, for accepting additional reinforcing such as zip ties or wire further engaged with webs or other features on outside corner form panel 300.

Figure 9B:
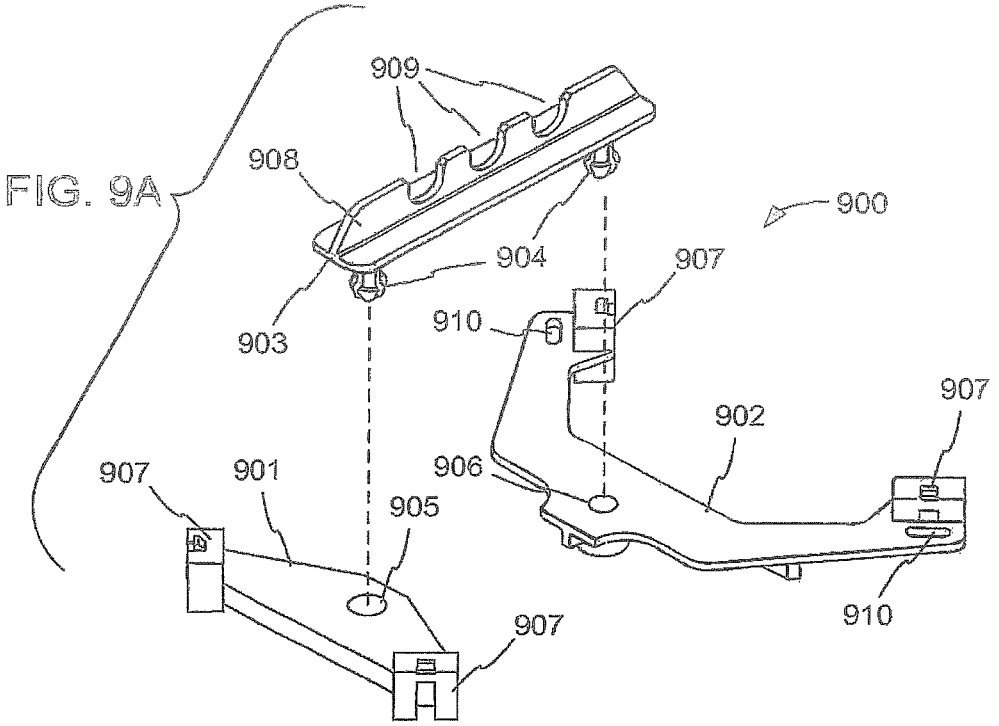
FIG. 9B shows an upper oblique view of the corner reinforcement of FIG. 9A in an assembled state.
Figure 9B:
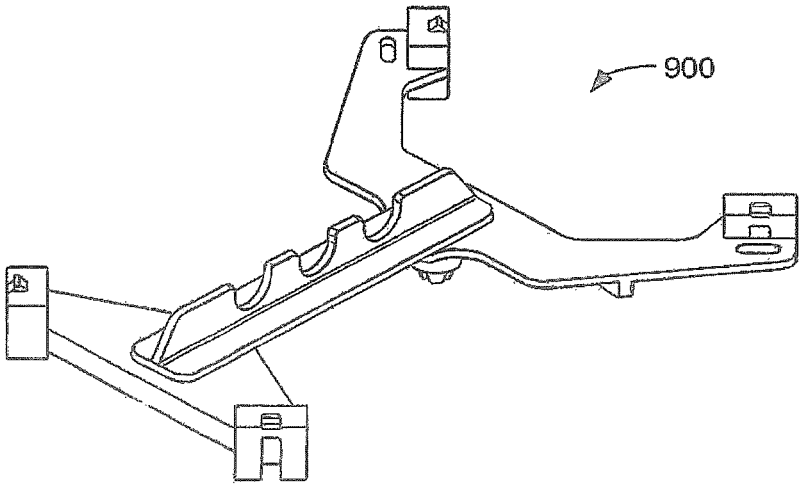
Figure 9C:
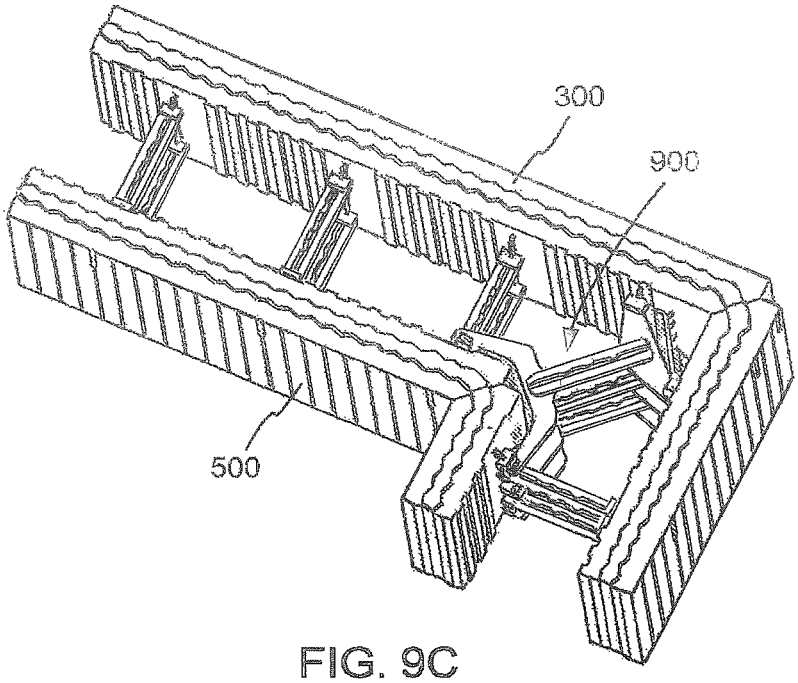
FIG. 9C shows the corner reinforcement of FIG. 9A in use.
Figure 9D:
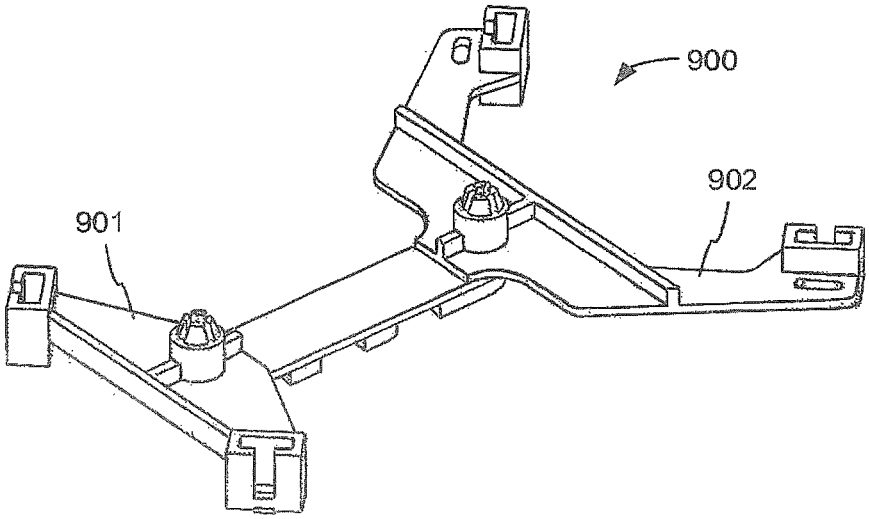
FIG. 9D shows a lower oblique view of the corner reinforcement of FIG. 9A in an assembled state.

Completed structural assembly 900 is shown in FIG. 9B. FIG. 9C shows structural assembly 900 in use, joining outer corner form panel 300 with inside corner form panel 500. FIG. 9D illustrates an underside view of structural assembly 900, showing how connector members 901 and 902 may be reinforced, in one embodiment. It will be appreciated that structural assembly 900 could include more or fewer than three parts. For example, all three elements 901, 902, and 903 could be combined into a single molded part.

Figure 10B:
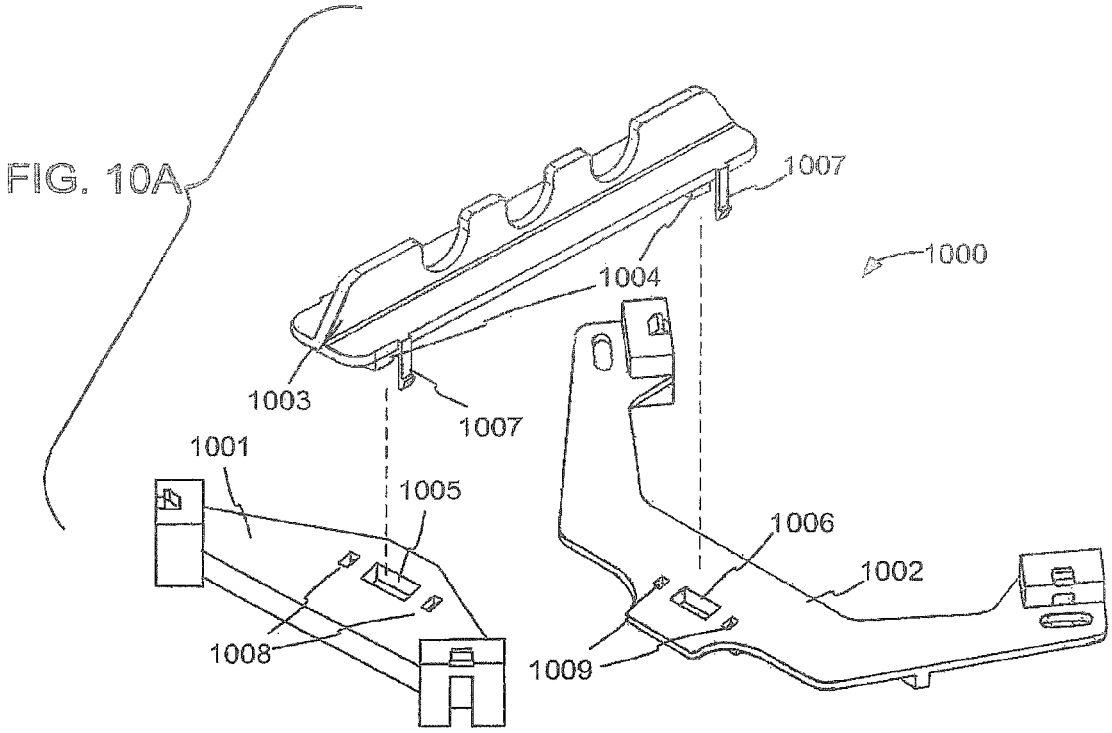
FIG. 10B shows an upper oblique view of the structural assembly of FIG. 10A in an assembled state.
Figure 10B:
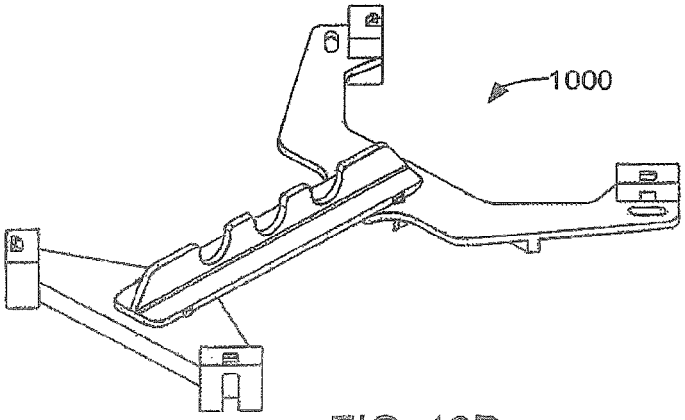

FIG. 10A illustrates an alternate structural assembly 1000 for reinforcing a corner joint, in accordance with other embodiments. Example structural assembly 1000 also includes three elements. A first connector 1001 is configured to attach to two of attachment features 16 of outside corner form panel 300. A second connector 1002 is configured to attach to two of attachment features 22 of inside corner form panel 500. A link 1003 engages first and second connectors 1001 and 1002 to join them. The engagement of link 1003 with first and second connectors 1001 and 1002 differs from the engagement of assembly 900 discussed above. In assembly 1000, rectangular posts 1004 of link 1003 engage with rectangular holes 1005 and 1006 of connectors 1001 and 1002. Snap features 1007 are configured to engage with snap receiving holes 1008 and 1009 in connectors 1001 and 1002. FIG. 10B shows structural assembly 1000 in its assembled state.

Figure 10C:
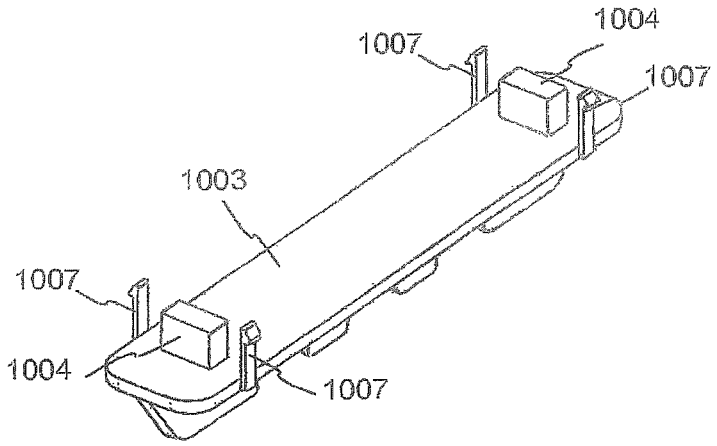
FIG. 10C shows a lower oblique view of a part of the structural assembly of FIG. 10A.
Figure 10D:
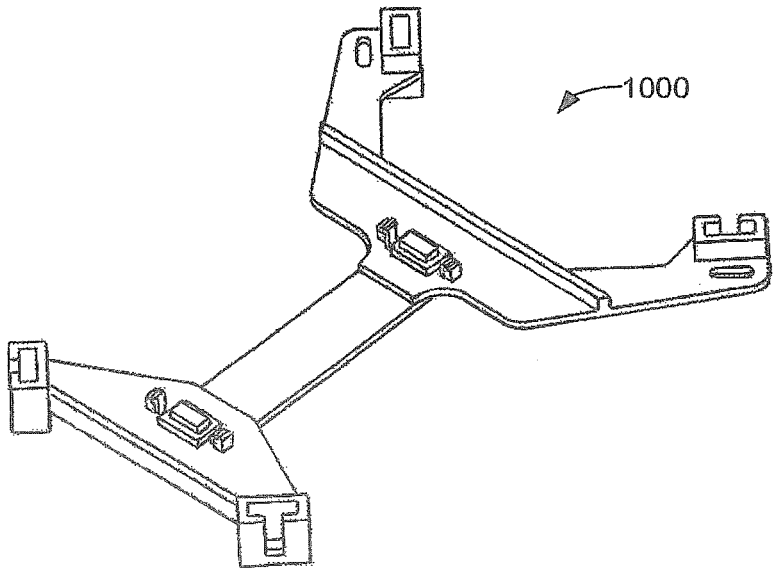
FIG. 10D shows a lower oblique view of the structural assembly of FIG. 10A in an assembled state.

FIG. 10C shows link 1003 in an inverted view, showing rectangular posts 1004 and snap features 1007 in greater detail. FIG. 10D shown completed assembly 1000 in an inverted view. Assembly 1000 may be used in a manner similar to assembly 900, as shown in FIG. 9C. The components of assembly 1000 may conveniently be molded of a suitable polymer, such as polypropylene, polycarbonate, acrylonitrile butadiene styrene (ABS), or another suitable polymer. Suitable components could also be made from metal, such as aluminum, sheet steel, or another material.

According to other embodiments, elements are provided that enable the construction of a corner form unit without any special corner web members. In this embodiment, panels having only web members such as web members 16 and 22 may be used to assemble a corner form unit.

Figure 11A:
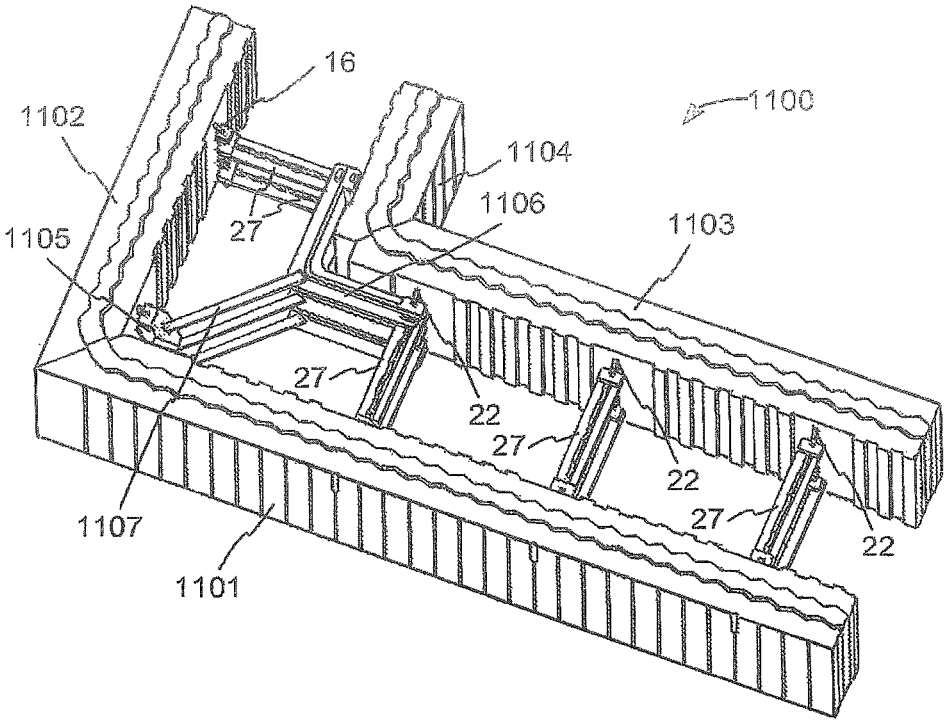
FIG. 11A shows an embodiment of a completed corner form unit according to the principles of the invention.

FIG. 11A shows an embodiment of a completed corner form unit 1100 according to principles of the invention. Corner form unit 1100 comprises a first outer panel 1101 and a second outer panel 1102. Outer panels 1101 and 1102 may be specially molded, or cut from standard (non-corner) wall-forming panels. Outer panels 1101 and 1102 have partially embedded within them web members 16, which in turn have attachment features protruding into the cavity of the corner form unit. Similarly, corner form unit 1100 includes first inner panel 1103 and second inner panel 1104, which may be specially molded or cut from standard wall-forming panels. Panels 1101-1104 are preferably molded or cut so that web members 16 and 22 align, enabling ties 27 to be installed to space the panels apart.

Special molded connectors are provided, to connect the panels at the corners, to stabilize the corner connections, and to reinforce the corner by connecting the inner panels to the outer panels across the cavity at the corners. One or more outer corner spanners 1105 connect two webs 16 at the inside of the corner formed by outer panels 1101 and 1102. Similarly, one or more inner corner spanners 1106 connect two webs 22 at the corner formed by inner panels 1103 and 1104. Outer and inner corner spanners 1105 and 1106 engage attachment features that are part of webs 16 and 22. In the example of FIG. 11A, zip ties 1107 join outer corner spanners 1105 to inner corner spanners 1106, to make the connection across the cavity between the panels. Wire or another kind of connection could also be used in place of zip ties 1107.

Figure 11B:
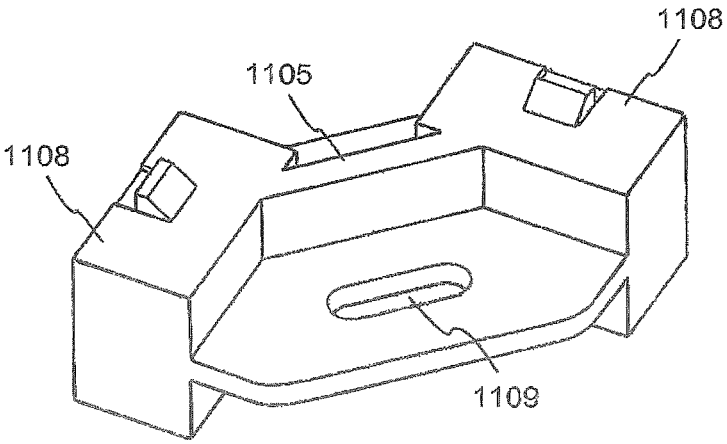
FIG. 11B shows an exemplary outer corner spanner.
Figure 11C:
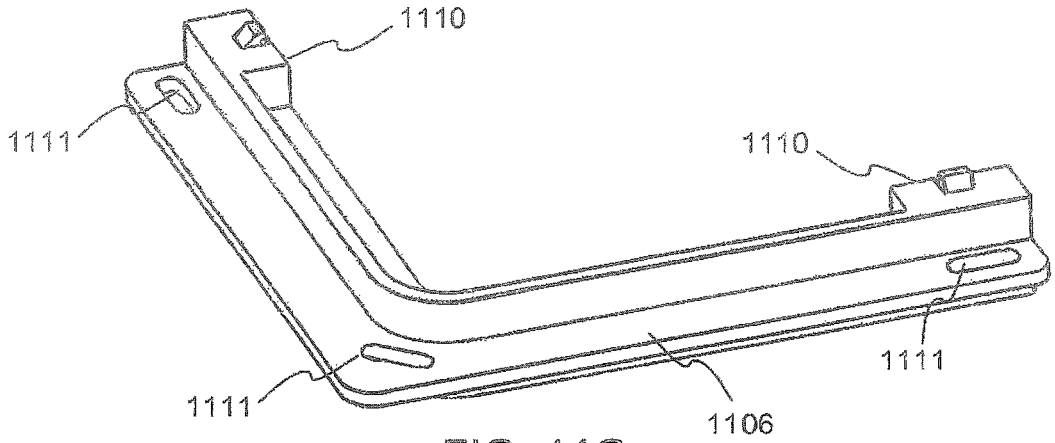
FIG. 11C shows an exemplary inner corner spanner.
Figure 11D:
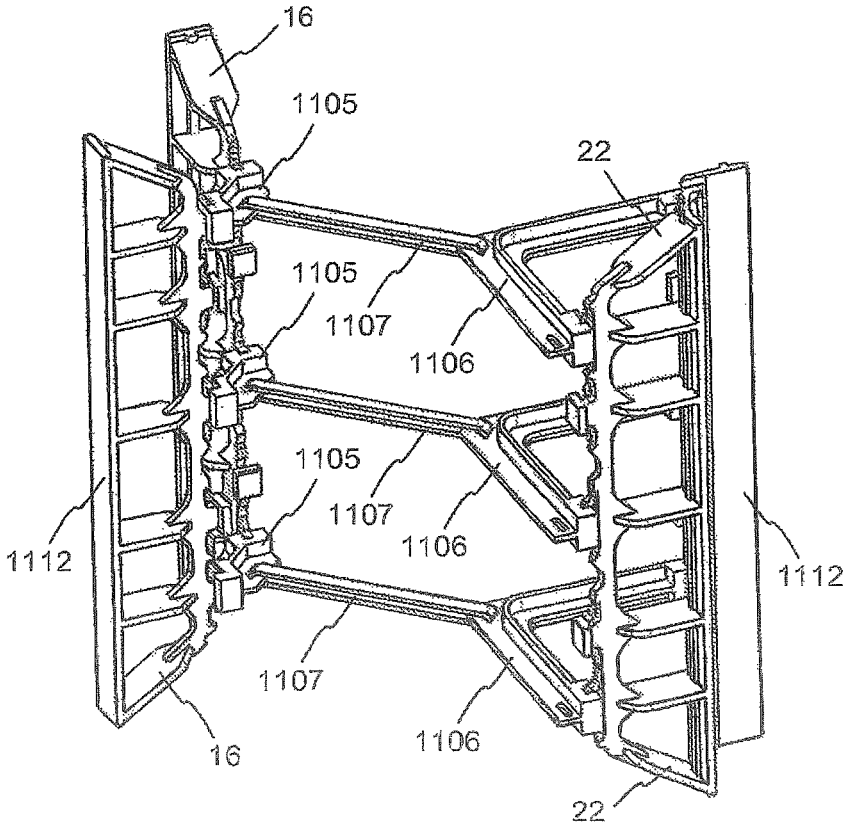
FIG. 11D shows the assembly of web members and corner spanners, in accordance with the principles of the invention.

FIG. 11B shows exemplary outer corner spanner 1105 in more detail, including features 1108 for engaging webs 16, and a slot 1109 for receiving a zip tie 1107. FIG. 11C shows exemplary inner corner spanner 1106 in more detail, including features 1110 for engaging webs 22, and slots 1111 for receiving zip ties 1107. FIG. 11D shows the assembly of web members 16, web members 22, outer corner spanners 1005, outer corner spanners 1006, and zip ties 1107, with the foam portions of panels 1101-1104 removed for clarity.

FIG. 11D also shows furring strips 1112 that are comprised in web members 16 and 22. Furring strips 1112 may be at least partially embedded within their respective foam panels, near the outer surfaces of the wall, and provide structure for attaching wall finishes. For example wall board, siding, mesh for adhering stucco, or other wall finishes could be screwed to the wall by engaging screws with furring strips 1112.

Outer corner spanners 1105 and inner corner spanners 1106 may conveniently be molded of a suitable polymer, such as polypropylene, polycarbonate, acrylonitrile butadiene styrene (ABS), or another suitable polymer. Suitable components could also be made from metal, such as aluminum, sheet steel, or another material.

Figure 12A:
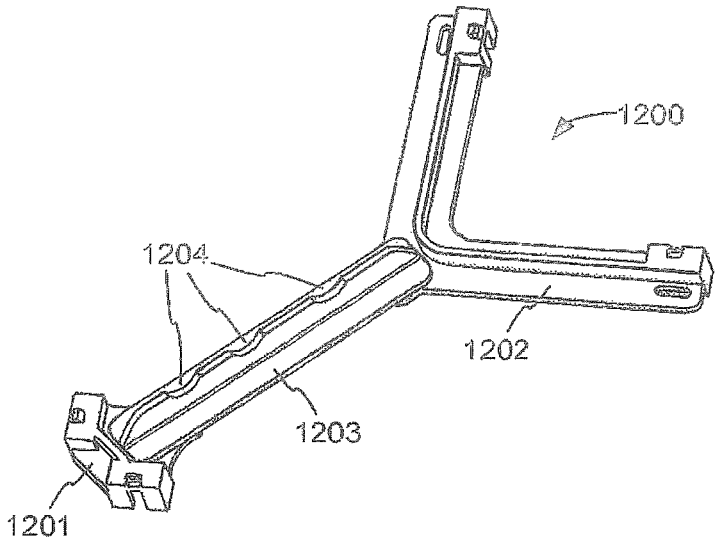
FIG. 12A shows an embodiment of a structural assembly according to the principles of the invention for connecting inside and outside corner panels.
Figure 12B:
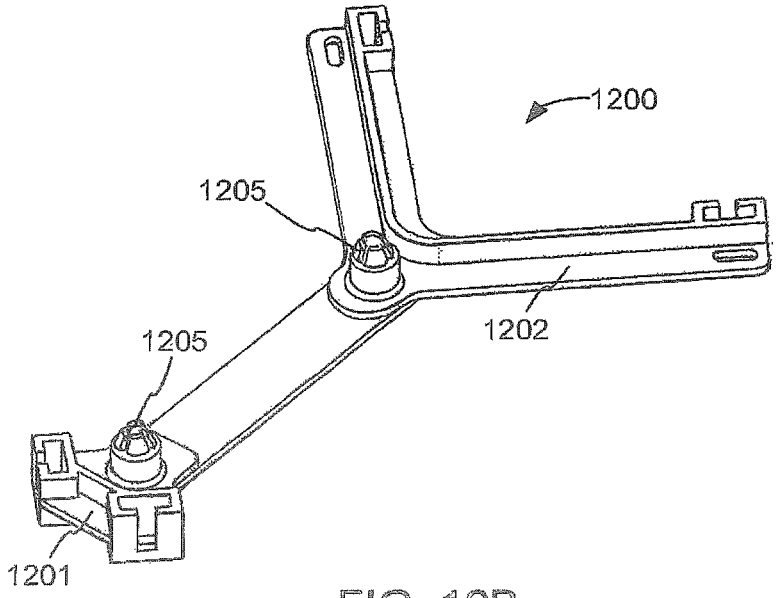
FIG. 12B shows in inverted view of the structural assembly of FIG. 12A.
Figure 12C:
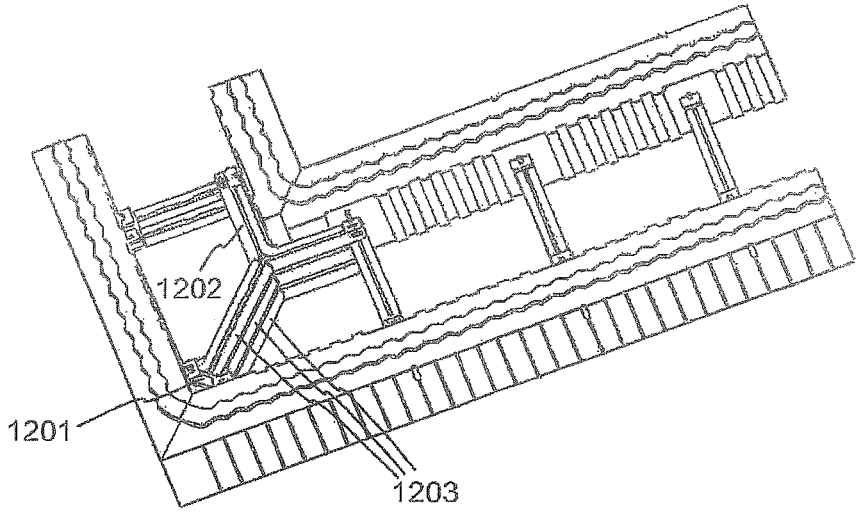
FIG. 12C illustrates a corner form unit assembled using the structural assembly of FIG. 12A.

In another embodiment, similar to the embodiment shown in FIGS. 11A-11D, a link member may be provided instead of using zip ties to connect outer corner spanners with inner corner spanners. For example, FIG. 12A shows a structural assembly 1200, including outer corner spanner 1201, inner corner spanner 1202, and link 1203. Structural assembly 1200 is configured to interconnect web members 16 and web members 22 in panels such as panels 1101-1104, to create a corner form unit. Link 1203 preferably snaps into outer corner spanner 1201 and inner corner spanner 1202. Link 1203 may include one or more seats 1204 for holding rebar. Assembly 1200 is shown in an inverted view in FIG. 12B, illustrating the snap engagement of link 1203 with outer corner spanner 1201 and inner corner spanner 1202. Exemplary snap features 1205 engage with holes in spanners 1201 and 1202. Any suitable kind of snap feature may be used. FIG. 12C illustrates a corner form unit assembled using structural assembly 1200. The components of structural assembly 1200 may be made of any suitable materials by any suitable process, including those listed above for outer corner spanners 1105 and inner corner spanners 1106.

Figure 13A:
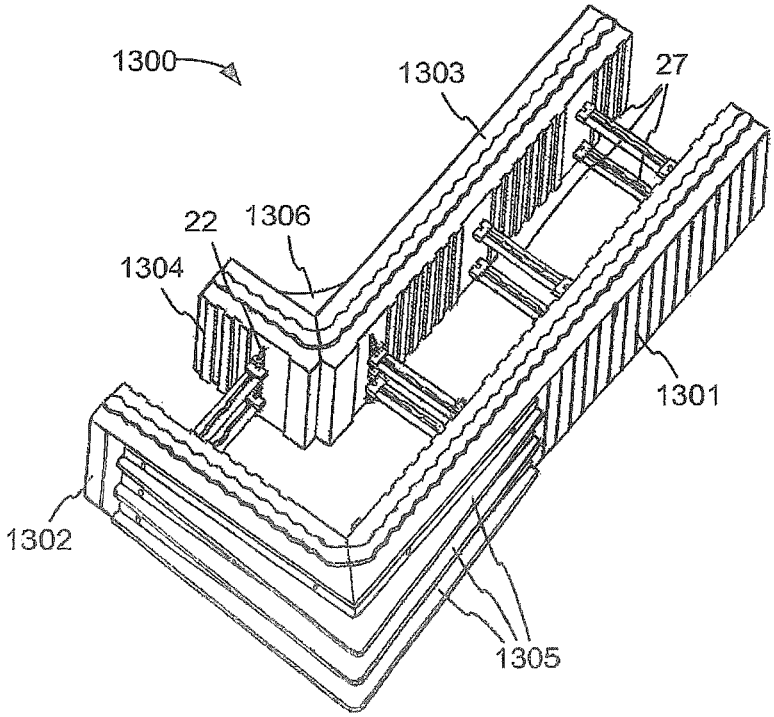
FIG. 13A shows an embodiment of a corner form unit assembled with external bracing, according to the principles of the invention.

In other example embodiments, a form corner may be braced from the outside, rather than from the inside. FIG. 13A shows a corner form unit 1300 assembled with external bracing. Exemplary corner form unit 1300 includes outer panels 1301 and 1302, and inner panels 1303 and 1304, which may be specially molded or cut from standard wall-forming panels. Outer panels 1301 and 1302 include embedded webs 16 (not visible in FIG. 13A), and inner corner panels 1303 and 1304 include embedded webs 22. Ties 27 join webs 16 with webs 22. Webs 16 and 22 include furring strips such as furring strips 1112 discussed above and shown in FIG. 11D (but not visible in FIG. 13A). Outer corner brackets 1305 are placed over the outer corner of form unit 1300, and are screwed to furring strips 1112 in webs 16. Inner corner brackets 1306 are placed in the inside corner of form unit 1300, and are screwed to furring strips 1112 in webs 22.

Figure 13B:
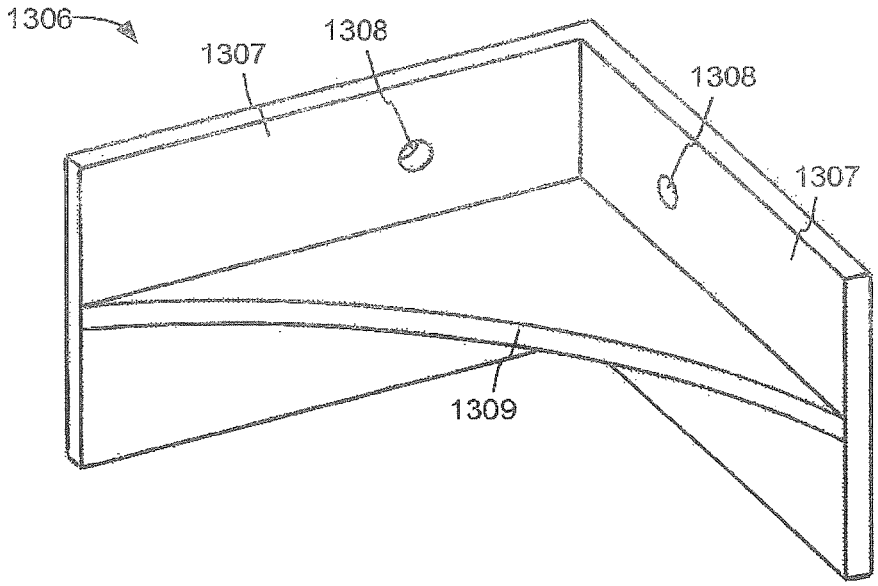
FIG. 13B shows an exemplary inner corner bracket.

FIG. 13B shows one of inner corner brackets 1306 in isolation. Exemplary inner corner bracket 1306 includes flanges 1307 for contacting inner panels 1303 and 1304. Flanges 1307 define holes 1308 for receiving fasteners for attaching inner corner bracket to inner panels 1303 and 1304, using furring strips embedded in the panels. A gusset 1309 lends strength to inner corner bracket 1306.

Figure 13C:
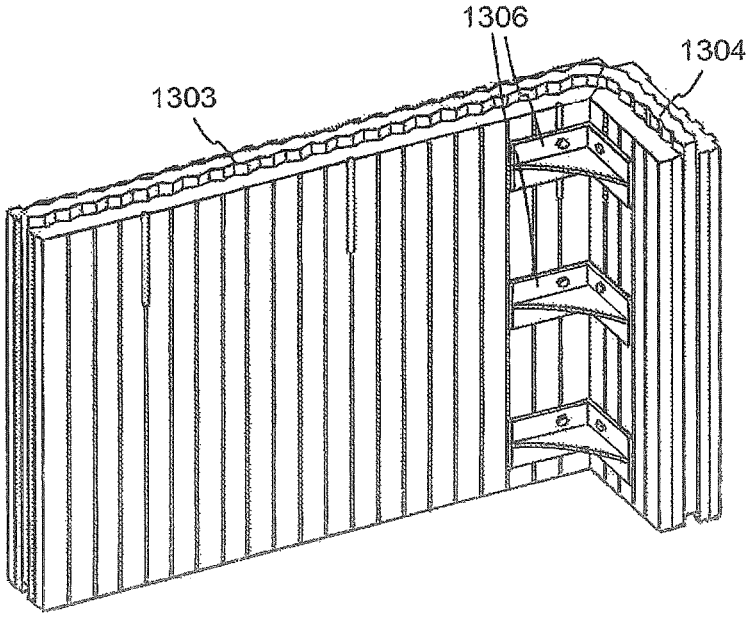
FIG. 13C shows the inner corner bracket of FIG. 13B in an installed configuration.

FIG. 13C shows three inner corner brackets 1306 in place between inner panels 1303 and 1304. More or fewer inner corner brackets 1306 may be used.

Figure 13D:
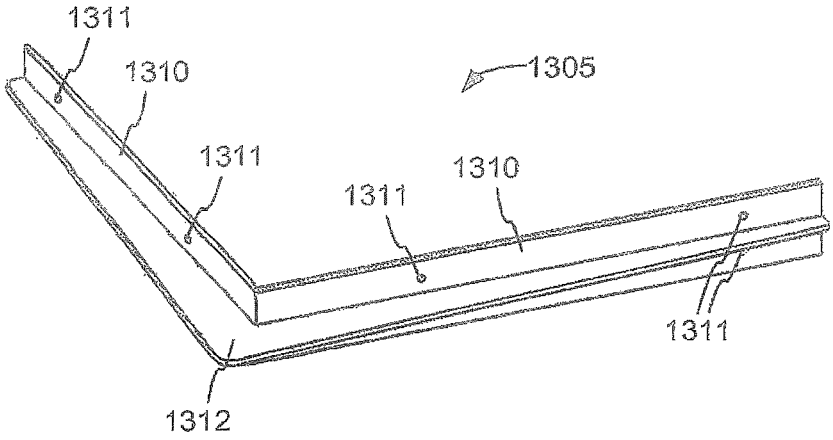
FIG. 13D shows an exemplary outer corner bracket.

FIG. 13D shows one of outer corner brackets 1305 in isolation. Exemplary outer corner bracket 1305 includes flanges 1310 for contacting outer panels 1301 and 1302. Flanges 1310 define holes 1311 for receiving fasteners for attaching inner corner bracket to inner panels 1301 and 1302, using furring strips embedded in the panels. An outer gusset 1312 lends strength to outer corner bracket 1305.

Inner corner brackets 1306 and outer corner brackets 1305 may conveniently be molded of a suitable polymer, such as polypropylene, polycarbonate, acrylonitrile butadiene styrene (ABS), or another suitable polymer. Suitable components could also be made from metal, such as aluminum, sheet steel, or another material.

Figure 13E:
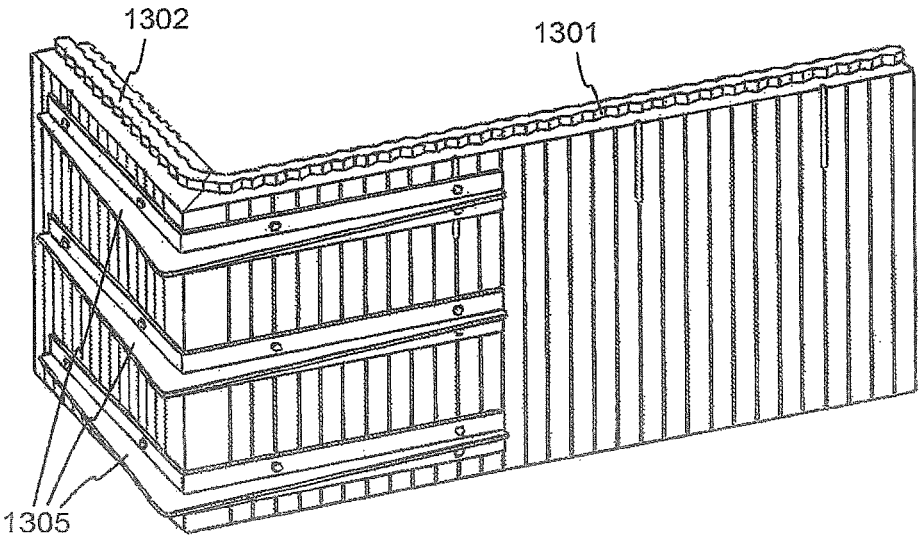
FIG. 13E shows the outer corner bracket of FIG. 13D in an installed configuration.

FIG. 13E shows three outer corner brackets 1305 in place between outer panels 1301 and 1302. More or fewer outer corner brackets 1305 may be used. Outer corner brackets 1305 and inner corner brackets 1306 are preferably removed once the concrete in the wall has hardened, and may be reused in another installation.

Figure 14:
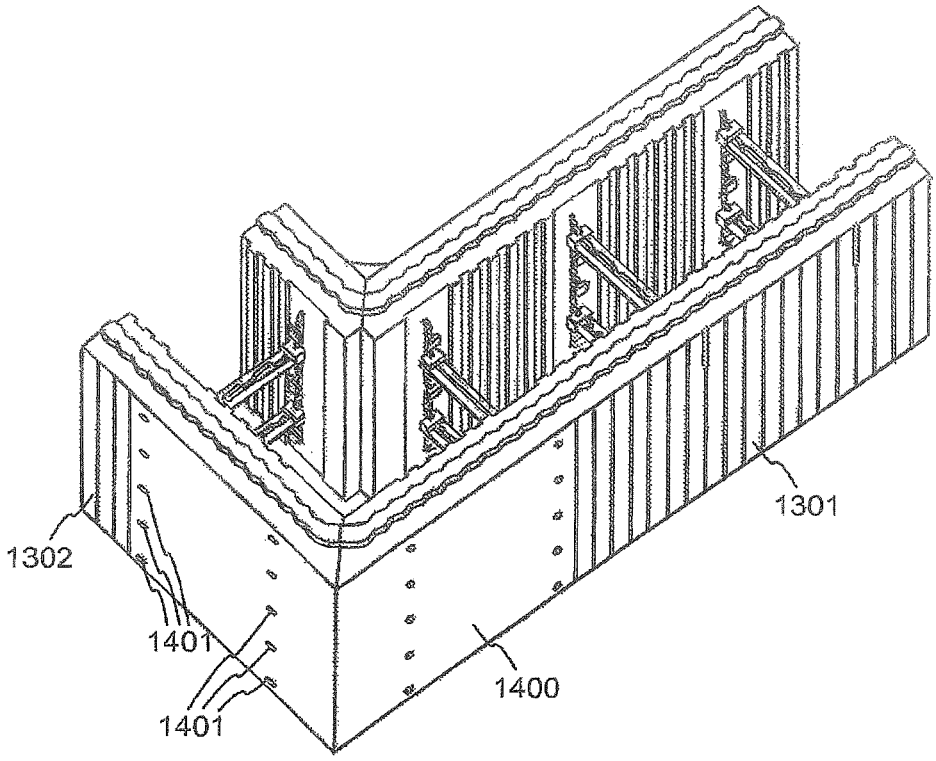
FIG. 14 illustrates another embodiment of external bracing of a corner form, in accordance with principles of the invention.

FIG. 14 illustrates another embodiment of a technique for external bracing of the corner formed by outer panels 1301 and 1302. In this embodiment, a sheet metal component 1400 is bent to match the angle of the corner being formed—a right angle in FIG. 14. Sheet metal component 1400 may be made, for example, of 16 gauge sheet steel, or another suitable material. Sheet metal component 1400 defines holes positioned to align with furring strips in webs embedded in outer panels 1301 and 1302. Sheet metal component 1400 may then be attached to outer panels 1301 and 1302 using screws 1401 or other fasteners.

Sheet metal component 1400 lends strength to the corner to withstand the pressures imparted by the poured concrete. Sheet metal component 1400 may be removed once the concrete has hardened.

Figure 15A:
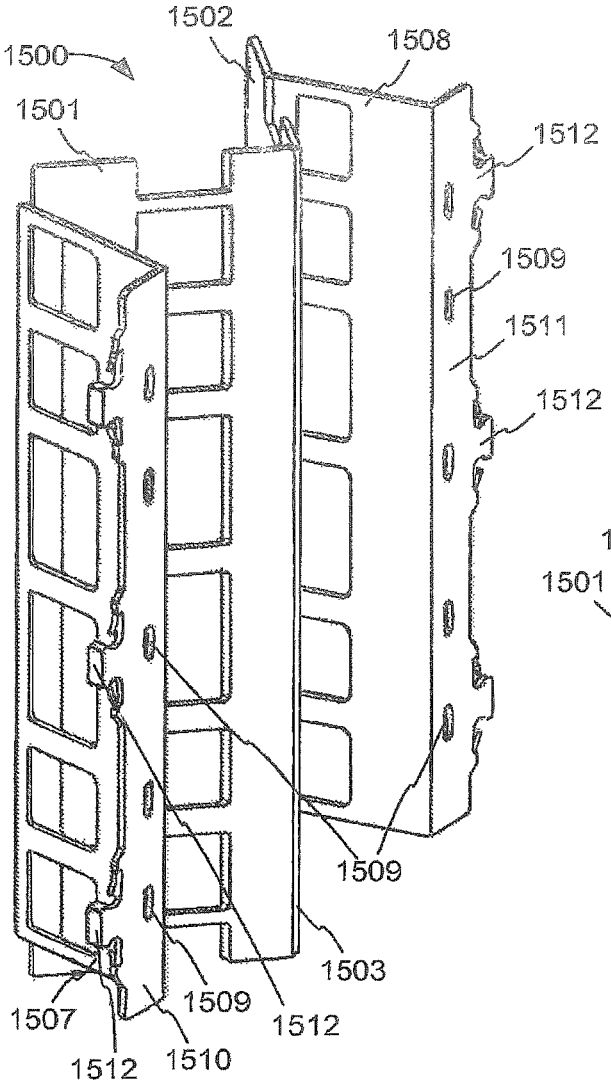
FIG. 15A illustrates an embodiment of an outside corner web member according to principles of the invention.
Figure 15B:
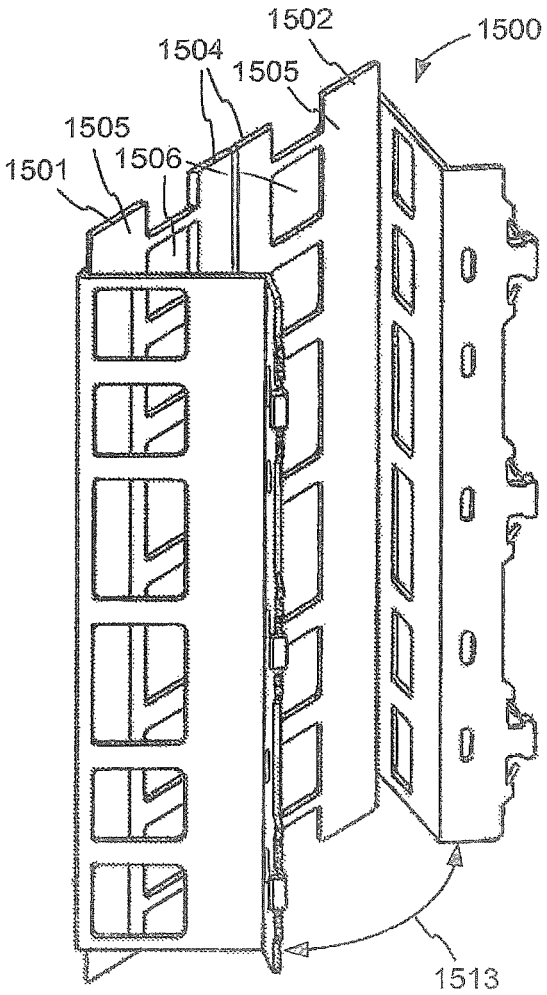
FIG. 15B shows the outside corner web member of FIG. 15A in another configuration.
Figure 15C:
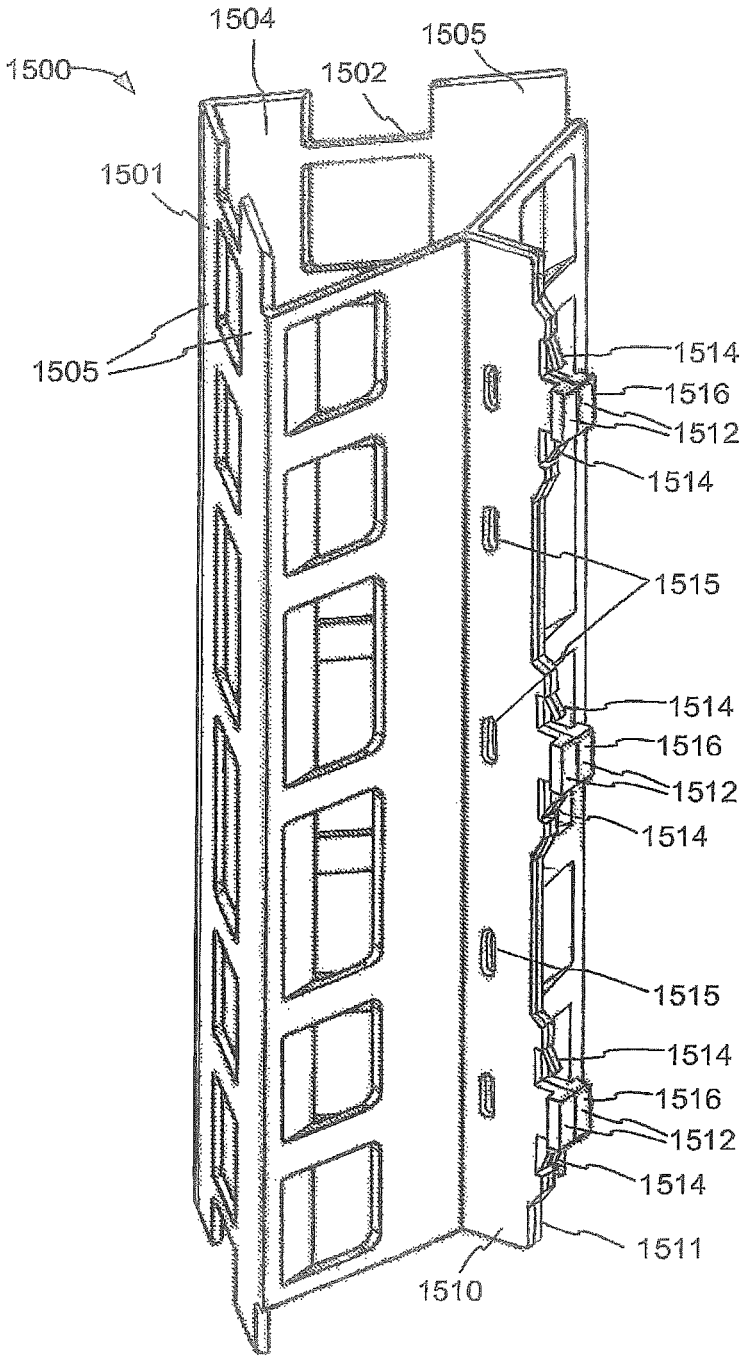
FIG. 15C shows the outside corner web member of FIG. 15A in another configuration.

FIGS. 15A-15C illustrate another embodiment of an outside corner web member 1500 according to principles of the invention. FIG. 15A shows outside corner web member 1500 in a configuration in which it may be molded, for example from polypropylene or another suitable polymer. Outside corner web member 1500 is similar in some ways to outside corner web member 1, shown in FIGS. 3A and 3B. For example, outside corner web member 1500 includes first and second generally flat inner portions 1501 and 1502, joined along a central longitudinal axis by a line of reduced thickness, forming a living hinge 1503. Each of central portions 1501 and 1502 includes a generally longitudinal inner furring strip 1504, and a generally longitudinal outer furring strip 1505, separated by openings 1506. Openings 1506 allow the foam material of form panels in which outside corner web member 1500 is embedded to flow through outside corner web member 1500 during molding of the foam panels, ensuring that outside corner web member 1500 is securely engaged with the foam panels.

Outside corner web member 1500 also includes wings 1507 and 1508, substantially rigidly joined to the outside edges of inner portions 1501 and 1502. Wings 1507 and 1508 also include openings for engagement with the foam material. Finally, protruding portions 1510 and 1511 are joined to the outer edges of wings 1507 and 1508. Protruding portions 1510 and 1511 define reinforcement connection openings 1509, configured for the attachment of additional tying elements.

Protruding portions 1510 and 1511 also include "half tee" features 1512. Each of half tee features 1512 forms half of a T-shaped (as viewed from the top) attachment feature configured for engagement by other components, as will be discussed in more detail below. Each attachment feature may be similar to the attachment features 104 of web members 16 and 22, illustrated in FIG. 11D. Other configurations are possible.

Outside corner web member 1500 is illustrated in FIG. 15B in a configuration in which it may reside in foam panels laid flat for shipping. In this configuration, protruding portions 1510 and 1511 form an angle 1513 that is equal to the supplement of the angle that will be formed by a corner form in the eventual wall. In the example of FIG. 15B, the eventual wall will have a right angle, so angle 1513 is also 90 degrees. If the eventual wall were to make an obtuse corner of 135 degrees, then angle 1513 would be only 45 degrees (180–135).

FIG. 15C illustrates outside corner web member 1500 in its orientation after the foam panel in which it is substantially embedded is folded to form a corner. Inner portions 1501 and 1502 now form a right angle, so that furring strips 1504 and 1505 are disposed near the outer corner of the foam panels. Protruding portions 1510 and 1511 have come together, so that half tee features 1512 now cooperate to form. T-shaped attachment features 1516. Snap features 1514 may also be provided. Snap features 1514 may be similar to those described in U.S. Pat. No. 6,438,918 to Moore et al, issued Aug. 27, 2002 and titled "Latching System for Components Used in Forming Concrete Structures", the which is incorporated by reference in its entirety herein. Protruding portions 1510 and 1511 also cooperate to define reinforcement connection openings 1515.

Figure 16A:
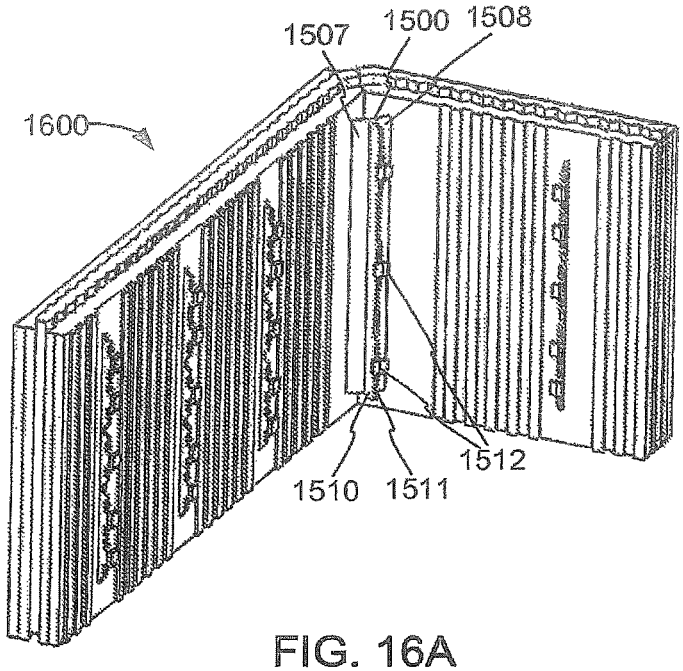
FIG. 16A illustrates an embodiment of an outside corner form panel according to principles of the invention, utilizing the outside corner web member of FIG. 15A.
Figure 16B:
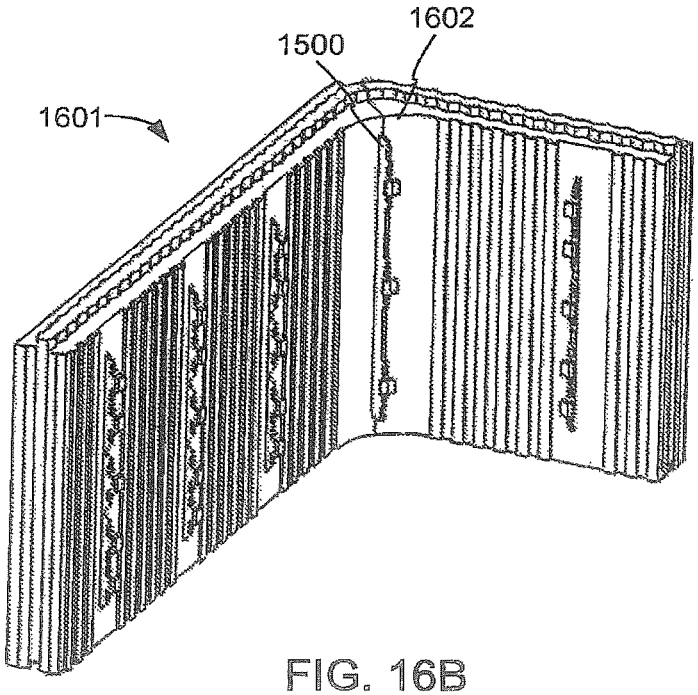
FIG. 16B illustrates another embodiment of an outside corner form panel according to principles of the invention.

FIG. 16A illustrates an embodiment of an outside corner form panel 1600 according to principles of the invention, utilizing outside corner web member 1500. Portions of outside corner web Member 1500 are visible, including portions of wings 1507 and 1508, protruding portions 1510 and 1511, and half-tee features 1512 that form attachment features 1516. FIG. 16B illustrates another embodiment of an outside corner form panel 1601. Outside corner form panel 1601 is similar to outside corner form panel 1600 and also utilizes outside corner web member 1500, but has a rounded shape at its inner corner 1602. This additional material may lend additional strength to outside corner form panel 1601.

Figure 16C:
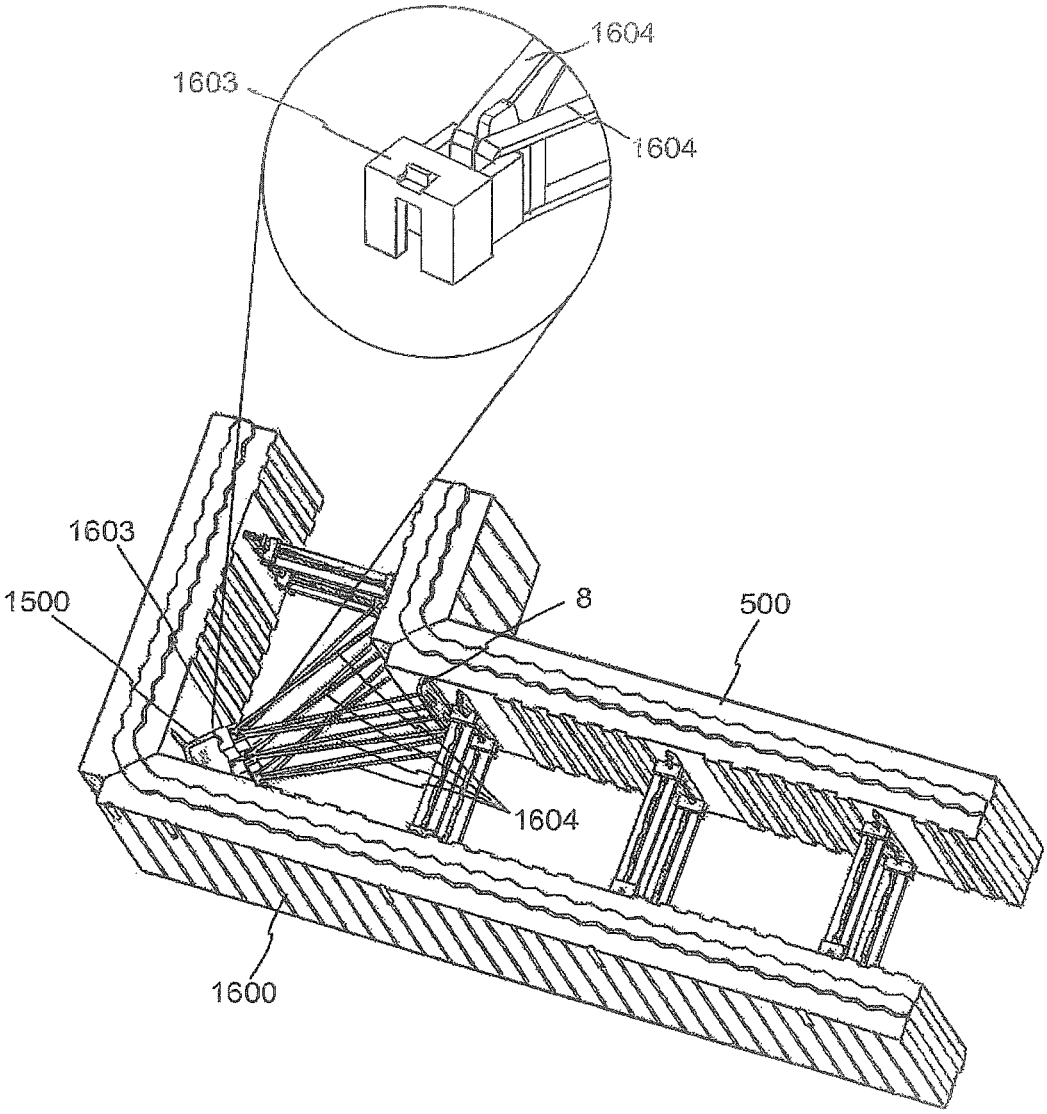
FIG. 16C illustrates an exemplary technique for securing an outside corner form panel to an inside corner form panel, in accordance with principles of the invention.

FIG. 16C illustrates an exemplary technique for securing an outside corner form panel such as panel 1600 to an inside corner form panel such as panel 500, in accordance with principles of the invention. In this example, an outside corner web member 1500 is embedded in outside corner form panel 1600, and an inside corner web member 8 is embedded in inside corner form panel 500. For at least some of the T-shaped attachment features 1516 formed by half-tee features 1512 of outside corner web member 1500, tie anchors 1603 are provided, and snap or otherwise engage with the T-shaped attachment features 1516 formed by half-tee features 1512. Tie anchors 1603 may be similar to those described in U.S. Pat. No. 6,438,918, previously incorporated by reference. Zip ties 1604, wire, or another kind of connector may extend between tie anchors 1603, and openings in inside corner web member 8.

Figure 16D:
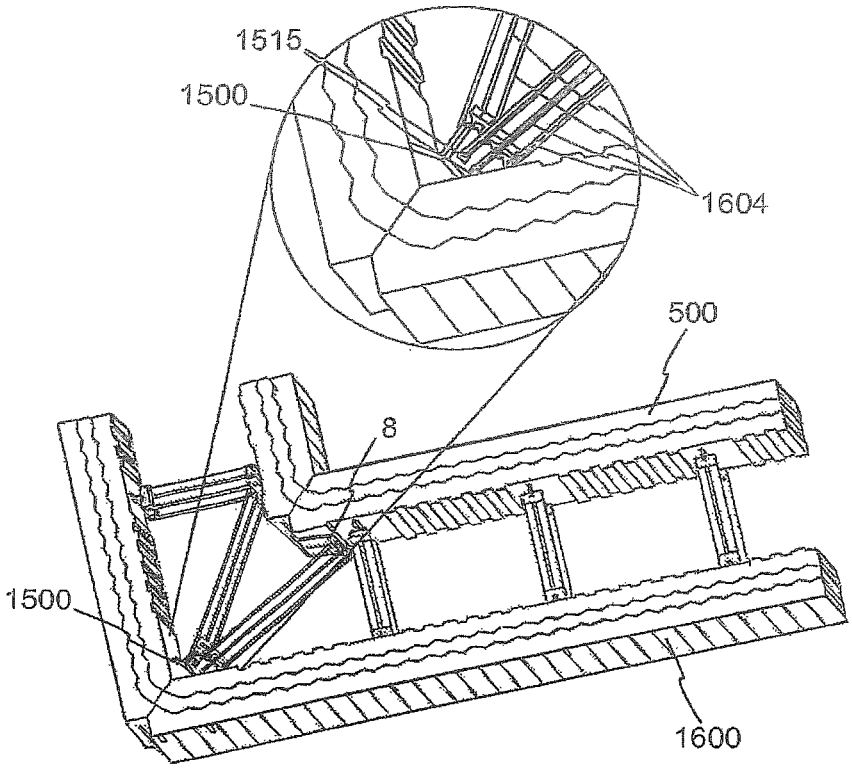
FIG. 16D illustrates another embodiment of a technique for securing an outside corner form panel to an inside corner form panel, in accordance with principles of the invention.

FIG. 16D illustrates another embodiment of a technique for securing an outside corner form panel such as panel 1600 to an inside corner form panel such as panel 500. In this example, an outside corner web member 1500 is embedded in outside corner form panel 1600, and an inside corner web member 8 is embedded in inside corner form panel 500. In this example embodiment, zip tics 1604 extend through reinforcement connection openings 1515.

Figure 17A:
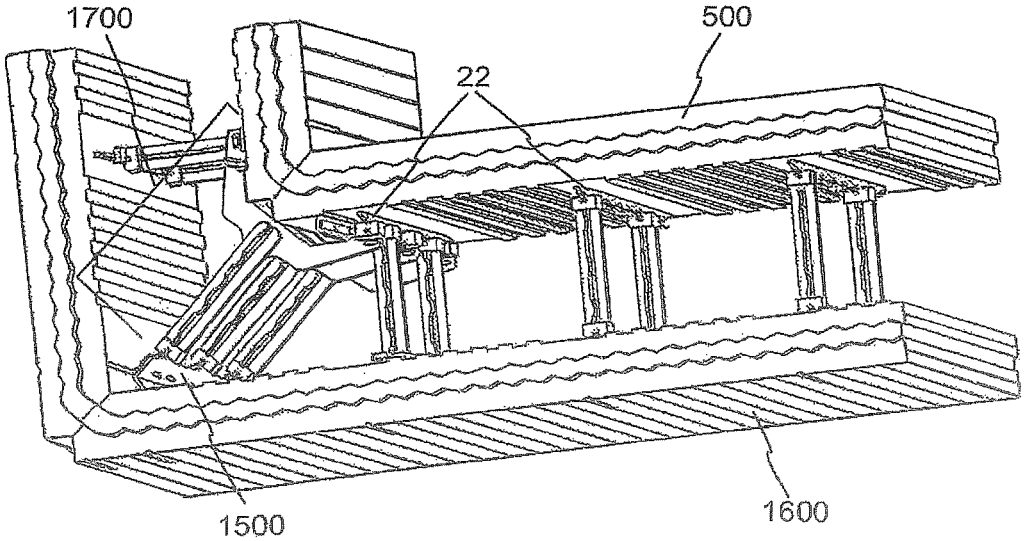
FIG. 17A illustrates still another embodiment of a technique for securing an outside corner form panel to an inside corner form panel, in accordance with principles of the invention.

FIG. 17A illustrates another embodiment of a technique for securing an outside corner form panel such as panel 1600 to an inside corner form panel such as panel 500, in accordance with principles of the invention. In this example, a structural assembly 1700 connects to T-shaped attachment features 1516 of inside corner web member 1500 to similar features on webs 22 of inside corner form panel 500.

Figure 17B:
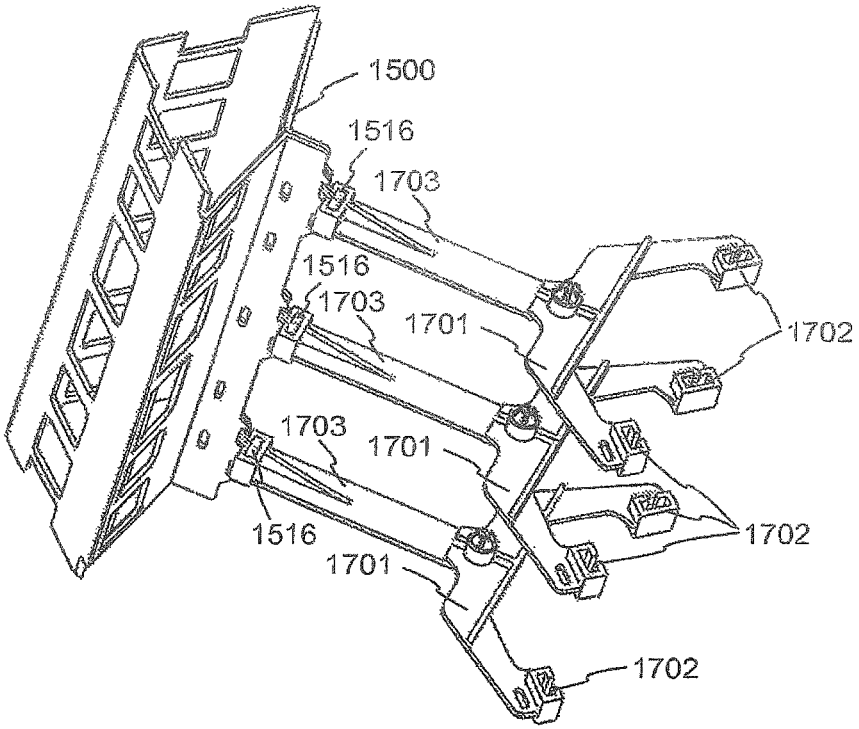
FIG. 17B illustrates portions of the system of FIG. 17A, with the foam panels removed for clarity.

FIG. 17B illustrates portions of the system of FIG. 17A, with the foam panels removed for clarity. FIG. 17B shows a bottom oblique view. Inner corner spanners 1701 include features 1702 for engaging webs 22. Links 1703 connect to inner corner spanners 1701 and also to the T-shaped attachment features 1516 of outer corner web member 1500. Once inner corner spanners 1701 and links 1703 are in place, outside corner form panel 1600 and inside corner form panel 500 are securely connected, and will stay in place during pouring of concrete in the cavity between the panels. The components of assembly 1700 may conveniently be molded of a suitable polymer, such as polypropylene, polycarbonate, acrylonitrile butadiene styrene (ABS), or another suitable polymer. Suitable components could also be made from metal, such as aluminum, sheet steel, or another material. In some embodiments, all of the components of the connection between outside corner form panel 1600 and inside corner form panel 500 snap together, to ensure that the connections remain in place during pouring and curing of the concrete. Preferably, the snap connections are removable.

Figure 17C:
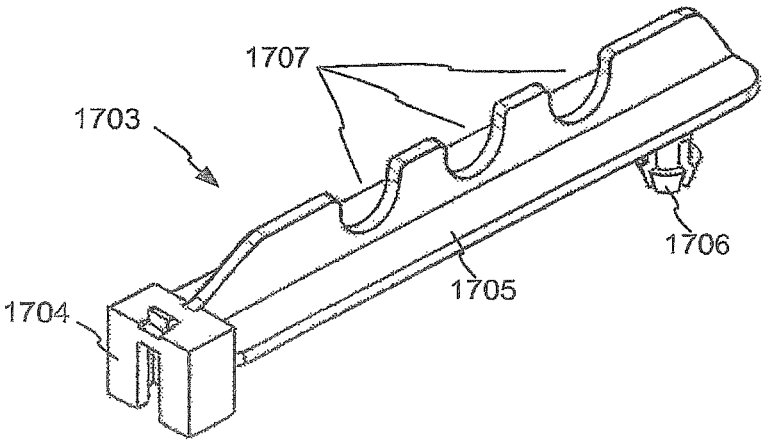
FIG. 17C shows an upper view of an example embodiment of a link shown in FIG. 17A.
Figure 17D:
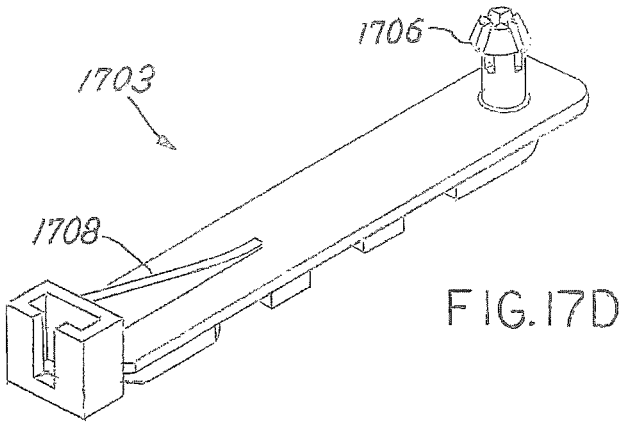
FIG. 17D shows a lower view of the link of FIG. 17C.

FIGS. 17C and 17D show upper and lower views of an example embodiment of link 1703, in isolation. Link 1703 is preferably moldable, and includes a feature 1704 on one end for engaging one of the T-shaped attachment features 1516 of outside corner web member 1500. At the other end of main body 1705, link 1703 includes a pin feature 1706, configured to engage a complementary feature on one of inside corner spanners 1701. Rebar seats 1707 may also be provided. Various reinforcing features may be provided, such as gusset 1708.

Figure 17E:
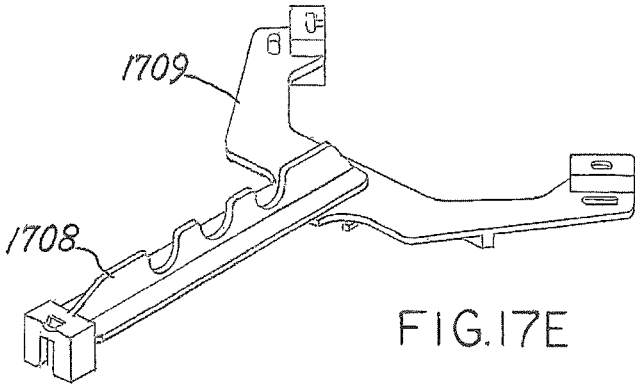
FIG. 17E shows an upper view of an embodiment of an assembly for securing an outside corner form panel to an inside corner form panel, in accordance with principles of the invention.
Figure 17F:
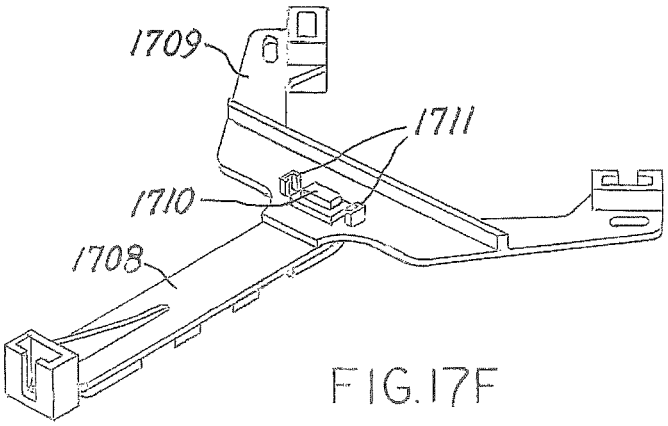
FIG. 17F shows a lower view of the assembly of FIG. 17E.

FIGS. 17E and 17F illustrate upper and lower views of another embodiment of assembly 1700. In this example, link 1708 is connected to inner corner spanner 1709 using a rectangular post 1710 with flanking snap features 1711.

The description given above is merely illustrative and is not meant to be an exhaustive list of all possible embodiments, applications or modifications of the invention. Thus, various modifications and variations of the described methods and systems of the invention will be apparent to those skilled in the art without departing from the scope and spirit of the invention. Although the invention has been described in connection with specific embodiments, it should be understood that the invention as claimed should not be unduly limited to such specific embodiments. Indeed, various modifications of the described modes for carrying out the invention which are obvious to those skilled in the art are intended to be within the scope of the appended claims.

What is claimed is:

1. A hinged, knock down, corner form panel assembly, comprising:

a first corner form and a second corner form, said first corner form and said second corner form each including:

a first insulating segment having inner and outer sides, a top, a bottom, a first beveled end, and a second end; and a second insulating segment having inner and outer sides, a top, a bottom, a first beveled end, and a second end;

each said first corner form and said second corner form further each including a corner web member, said corner web member partially embedded in said first beveled ends of said first and second segments and including first and second connection portions protruding respectively from said first segment and said second segment, said corner web member further including a flexible portion joining said first and second connection portions enabling said first and second segments to be angularly displaced relative to each other from a first configuration in which each said first and second segments are not disposed with said beveled ends substantially touching to a second configuration in which said beveled ends of each said corner form first and second segments are substantially touching to form a corner; and a corner reinforcement connector assembly joining the inner sides of the first and second segments at the corner of the first corner form to the outer sides of the first and second segments at the corner of the second corner form joining the corners of the first and second corner forms in the second configuration, said corner reinforcement connector assembly comprising a first connector attachable to the inner sides of the first and second segments of the first corner form, a second connector attachable to the outer sides of the first and second segments of the second corner form, and a link joining the first and second connectors.

2. The corner form assembly of claim 1 wherein said link includes rebar seats.

3. The corner form assembly of claim 1 wherein said corner reinforcement connector assembly is detachable.

4. The corner form assembly of claim 1 further including a tie connecting the inner side of the first segment of the first corner form with the outer side of the first segment of the second corner form.

5. The corner form assembly of claim 4 wherein the tie is detachable.

6. The corner form assembly of claim 1 further including a tie connecting the inner side of the second segment of the first corner form and the outer side of the second segment of the second corner form.

7. The corner form assembly of claim 6 wherein the tie is detachable.

8. The corner form assembly of claim 1 wherein the corner reinforcement connector assembly comprises at least two separate detachable parts.

9. The corner form assembly of claim 1 wherein the corner reinforcement connector assembly comprises three detachable parts.

* * * * *